US005561873A

United States Patent [19]

Weedling

[11] Patent Number: 5,561,873

[45] Date of Patent: Oct. 8, 1996

[54] AIR CHAMBER-TYPE PATIENT MOVER AIR PALLET WITH MULTIPLE CONTROL FEATURES

[75] Inventor: Robert E. Weedling, Center Valley, Pa.

[73] Assignee: Patient Transfer Systems, Inc., Allentown, Pa.

[21] Appl. No.: 493,634

[22] Filed: Jun. 22, 1995

Related U.S. Application Data

[63] Continuation of Ser. No. 275,846, Jul. 15, 1994, abandoned.

[51] Int. Cl.[6] ..... A61G 7/10

[52] U.S. Cl. ..... 5/711; 5/81.1 R; 5/713; 5/706

[58] Field of Search ..... 5/455, 456, 477, 5/453, 468, 469, 449, 81.1; 180/124, 125

[56] References Cited

U.S. PATENT DOCUMENTS

| | | | |
|---|---|---|---|
| 2,919,747 | 1/1960 | Post | 5/457 |
| 3,253,861 | 5/1966 | Howard | 5/449 X |
| 3,705,429 | 12/1972 | Nail | 5/455 |
| 4,391,009 | 7/1983 | Schild et al. | 5/453 |
| 4,528,704 | 7/1985 | Wegener et al. | 180/125 X |
| 4,631,767 | 12/1986 | Carr et al. | 5/457 |
| 4,686,719 | 8/1987 | Johnson et al. | 180/125 X |
| 4,908,895 | 3/1990 | Walker | 5/457 X |
| 5,065,464 | 11/1991 | Blanchard et al. | 5/453 X |
| 5,067,189 | 11/1991 | Weedling et al. | 5/455 |
| 5,249,318 | 10/1993 | Loadsman | 5/469 X |

*Primary Examiner*—Michael F. Trettel
*Attorney, Agent, or Firm*—Sanford J. Piltch

[57] ABSTRACT

An inflatable flexible pallet having generally rectangular dimensions defined by top and bottom sheets within which an array of structurally interrelated inflatable chambers are formed to support a load when inflated. The flexible pallet is configured to resist lateral and longitudinal shrinkage of the load support surface, resist ballooning and hot dogging, and reduce rotational instability by providing a greater load surface support area having sufficient rigidity to support the desired load, while simultaneously achieving improved air dispersion for a more uniform jacking of the load, and maintaining a preset internal pressure using an automatic self-regulating valve to provide circulatory therapy to a patient lying atop the pallet for an extended period. The flexible pallet is further configured to provide for the transfer of the load over an underlying rigid surface through the use of a pattern of escape ports through the bottom sheet or by the incorporation of a separately inflatable underlying plenum chamber having a similar pattern of escape ports for creating an air film upon which the pallet can be moved.

61 Claims, 6 Drawing Sheets

AIR CHAMBER-TYPE PATIENT MOVER AIR PALLET WITH MULTIPLE CONTROL FEATURES

This application is a Continuation of application Ser. No. 08/275,846, filed Jul. 15, 1994, now abandoned.

FIELD OF THE INVENTION

This invention relates to air pallets, and more particularly to air pallet-type patient movers for facilitating comfortable support for and transfer of patients and more particularly to a semi-rigid air pallet in which a series of compressed air filled chambers, or the like, form one or more backing chambers which function as a generally rigid backing member.

BACKGROUND OF THE INVENTION

The present invention is an outgrowth of the development of an air pallet using low pressure, low cfm air flow exemplified by U.S. Pat. No. 3,948,344 entitled "LOW COST PLANAR AIR PALLET MATERIAL HANDLING SYSTEM", issued Apr. 6, 1976, and U.S. Pat. No. 4,272,856 entitled "DISPOSABLE AIR-BEARING PATIENT MOVER AND VALVE EMPLOYED THEREIN", issued Jun. 16, 1981 Planar air pallets and air-bearing patient movers of such type employ at least a thin, flexible bottom sheet for partially defining a plenum chamber, with said one sheet being perforated by way of small, closely spaced pinholes over a surface area defined by the imprint of the load, which pinholes face an underlying fixed, generally planar support surface. The pinholes open unrestrictedly to the interior of the plenum chamber and to the planar support surface. When the plenum chamber is pressurized by low pressure air, initially the air jacks the load upwardly above the thin, flexible sheet, then air escapes under pressure through the minute pinholes and creates a frictionless air bearing of relatively small height between the underlying support surface and the bottom of the perforated flexible sheet.

In all air pallets, including patient movers, it is necessary to provide controlled pillowing of the thin, flexible sheet material, particularly outside the perforated surface area of that sheet to initially jack the load above the flexible sheet prior to the creation of the frictionless air bearing and to insure the ability of the air pallet to ride over surface projections on the underlying support surface. Means must also be provided within the air pallet to prevent ballooning of the thin, flexible sheet or flexible sheets defining the plenum chamber whereby the plenum chamber takes a circular or near circular vertical cross section, the result of which could be the tilting or rolling of the load off the top of the air pallet. Further, when the load rests on the air pallet, prior to the pressurization of the plenum chamber the load tends to press the perforated flexible sheet into contact with the underlying support surface which prevents the entry of air under light pressure into the plenum chamber. Thus, air dispersion means are required either interiorally or exteriorally of the plenum chamber to ensure pressurization of the plenum chamber.

Under certain circumstances, the load may additionally constitute a generally rigid, i.e., semi-rigid backing member. A cardboard box filled with material for transport may have the planar bottom functioning as a generally rigid backing member. Where the air pallet is formed essentially of a thin, flexible sheet material, a bag of grain acting as the load may constitute a generally rigid backing member.

In the development of the air pallets, and in particular air bearing patient movers as a form of such air pallets as exemplified by U.S. Pat. No. 3,948,344, a corrugated sheet such as sheet 34 within the single chamber functioning as a plenum chamber in a patient mover formed by two superimposed thin, flexible sheets 12, 14 in U.S. Pat. No. 4,272,856 may constitute both a unitary air dispersion means and a semi-rigid backing member (if needed). The semi-rigid backing member may comprise a semi-rigid sheet inserted within a cavity formed between the top thin, flexible sheet and an intermediate thin, flexible sheet. Alternatively, the backing member may be formed of a series of transversely linked air pressurized tubes formed by sealing off parallel, laterally adjacent longitudinal sections of the top sheet and the intermediate sheet. Such tubes may be completely sealed and air pressurized through valves. In a flow-through system, the pressurized air forming the air bearing passes first through parallel, transversely linked tubes defined by the top and intermediate sheets and then into the plenum chamber defined by the intermediate sheet and the bottom sheet with the bottom sheet bearing the pattern of perforations over the foot print of the load. U.S. Pat. No. 4,528,704 issued to Jack Wegener and Raynor D. Johnson, on Jul. 16, 1985 and entitled "SEMI-RIGID AIR PALLET TYPE PATIENT MOVER" is directed to such air pallets.

Flow-through chambers connected by succeedingly smaller sized ports within horizontally extending vertically spaced walls define a series of stacked chambers in a gas pressurized jacking structure and an air pallet including such jacking structure and forms the subject matter of U.S. Pat. No. 4,417,639 issued to Jack Wegener on Nov. 29, 1983 and entitled "DYNAMIC GAS PRESSURIZED JACKING STRUCTURE WITH IMPROVED LOAD STABILITY AND AIR PALLET EMPLOYING SAME". Further, as evidenced in FIG. 10 thereof, such jacking structure may be formed totally of thin, flexible sheet material with vertically separated chambers in communication via a gas passage whose cross-sectional area is smaller than that of the air inlet to the upper chamber thereof through the air inlet hose.

In the semi-rigid air pallet type patient mover of U.S. Pat. No. 4,686,719 entitled "SEMI-RIGID AIR PALLET TYPE PATIENT MOVER", U-straps are sewn to the lateral sides of the patient mover structure for facilitating lateral shifting of the patient placed thereon with the plenum chamber gas pressurized and a thin air film underlying the perforated area of the thin, flexible bottom sheet. The patient may be bound to the top of the patient mover via a pair of crossed VELCRO hook and loop material covered straps for ease in engagement and disengagement of the strap ends about the patient.

In the field of air pallets and particularly of the patient mover type those patient movers formed of multiple, thermal bonded or stitched sheets of thin, flexible sheet material which incorporate a rigid or a semi-rigid sheet as the load backing member are not universally employed in health care treatment facilities. The existence of the rigid or semi-rigid sheet carried within a pocket or cavity defined by two thin, flexible sheets renders the assembly bulky, and adds considerably to the weight of the same. While such patient mover may perform extremely well at a certain hospital station or treatment area such as facilitating patient movement onto and from an X-ray table, the patient mover remains at the area and is unlikely to be employed in moving the patient to and from the hospital bed remote from the X-ray area since hospital personnel resist transporting such patient mover from location to location.

The same is true where the air pallets such as patient movers are utilized by paramedics, shock trauma units or the like. As a result, recently there has been shown considerable interest in the development of soft pad or hard pad air chamber-type air pallets as patient movers or as patient positioners devoid of such rigid or semi-rigid sheet. In the health care field, particularly, the person transported or changed in position in many cases is not truly a patient recovering from sickness, but one requiring continuous attention, such as an invalid or partial invalid. In this case, upon either transport, or positioning and maintaining the patient comfortable in a given partially upright or supine position, the possibility of a tissue breakdown exists with the need for inducing therapy during the time that the patient remains in such given positions for a significant period of time. Essentially, there exists the need for the prevention of skin breakdown which can occur within a very short time whether the patient is in a health care facility or hospital, even while on the operating table of such hospital.

The applicants have determined that there are significant differences between the rigid back air pallet and the flexible or air chamber-type air pallet with a load that can flex. In the development of air pallets and air pallet-type patient movers utilizing a thin, flexible bottom sheet partially defining a plenum chamber and being perforated by way of thousands of small, closely spaced pinholes over the surface area defined by the imprint of the load and which open unrestrictedly to the interior or the plenum chamber and to an underlying planar support surface, such air pallets and air pallet-type patient movers have generally employed a rigid backing member starting with U.S. Pat. No. 3,948,344. Exceptions lie in the patient mover of U.S. Pat. No. 4,272,856, and in the patient mover illustrated in FIGS. 4 and 5 of U.S. Pat. No. 4,528,704.

Certain structural features and parameters with respect thereto play a very important part in the successful operation of an air pallet having a rigid backing member. The key for successful movement of a load on a developed air film by air escape from the perforations is to make the air work on the load and to control the action of the air in doing that job. By matching the footprint of the load to that of the plenum chamber pattern area of perforations, thus generally matching the area of the developed air film to that of the load, the air pallet with the plenum chamber pressurized will jack the load, create the air bearing and permit the load to be stably moved on the air pallet.

If the mass of the load is spread through too small an area against the plenum chamber, i.e., point loading, the load may ground out that portion of the plenum chamber between the load and the underlying planar support surface causing the thin, flexible sheet to bulge out around the point load application against the top of the plenum chamber. Thus, with the plenum chamber up and about the sides of the load, the load is not lifted, the air does not escape through the perforations and no effective air bearing is created. When the load footprint is less than the plenum chamber air film footprint, a significantly greater pressure is needed to lift the load.

Successful operation of rigid backing surface type air pallets requires controlled jacking, controlled pillowing and anti-ballooning. Control of load distribution may be achieved by the use of a rigid backing member such as a board or sheet as part of the plenum chamber, or within a separate chamber supporting the load but overlying the plenum chamber. The rigid backing member distributes the load mass balanced equally over the area of the plenum chamber footprint. The control of the plenum chamber can be performed in several ways and a properly designed plenum chamber can effect several of the control functions, i.e., jacking, pillowing and ballooning.

The term "jacking" covers the act of raising the load so that air can enter into and be distributed throughout a plenum chamber, or multiple plenum chambers, and then pass out through the perforations to form the air film or air bearing while permitting the planar rigid backing surface to support the load and allow it to move on the film of air.

The term "pillowing" describes the ability of the thin, flexible sheet to deform so as to ride over or under surface irregularities in the generally planar support surface (ground, floor, etc.) without bottoming out. If the compressed air within the plenum chamber does not jack the load high enough, the rigid backing member will ground out against the thin, flexible bottom sheet and the surface irregularity (vertical projection).

The term "ballooning" describes the situation where the load is jacked or raised up so high that the load becomes unbalanced on the footprint formed by the plenum chamber. This is normally caused by the thin, flexible sheet tending to become hemispherical (where a generally rigid planar backing member acts in conjunction with the thin, flexible bottom sheet bearing the perforations to form the plenum chamber). The hemispherical configuration given to the thin, flexible bottom sheet permits it to roll about the curved surface tilting to the extent where the load may be dislodged. As may be appreciated, the pillowing control functions as an anti-ballooning means. Absent the generally rigid planar backing member, where the plenum chamber is formed of thin, flexible sheet material such as a bag, the bag will take a circular cross-section when fully pressurized, the true essence of a balloon.

Where the thin, flexible bottom sheet is tightly connected at opposite sides to the generally rigid backing member that rigid backing member functions to control jacking, pillowing and ballooning. Where the rigid backing member is smaller than the thin, flexible bottom sheet, slack develops within the thin, flexible bottom sheet which increases the pillowing capability of the thin, flexible bottom sheet. Excessive slack leads to ballooning.

Other means have been provided for controlling pillowing, such as the lamination of additional members to a center sheet or to either the upper thin, flexible sheet or the bottom thin, flexible sheet. The addition of internal strips lying diagonally from corner to corner within the plenum chamber or vertical from face to face, control the degree of pillowing. The load itself may act as a pillowing control means. The insertion of a rigid plate internally within a thin, flexible bag acts both as a rigid backing member, a pillowing control means and, under certain conditions, an air distribution means for insuring air pressurization of the plenum chamber with the air pallet formed principally by the bag supporting the load prior to air pressurization of that plenum chamber. The size of the blower and thus the air pressure developed within the plenum chamber may constitute pillowing control means, as may valving or gating of the air flow system entering the plenum chamber and creating the air bearing, and the stiffness or flexibility of the material used in forming the thin, flexible bottom sheet. The area of the material around the perforation pattern and between that pattern and the rigid backing member is normally the primary pillowing control means for such air pallets. The proximity of the perforation pattern to the outside edge of the plenum chamber, the slack in the plenum chamber and the rigidity of the backing member all constitute aspects of the pillowing control.

In U.S. Pat. No. 4,272,856 for an operative air pallet-type patient mover, pillowing is controlled by having the pattern of perforations extending to the edge of the plenum chamber and the sides of the plenum chamber are purposely designed to match the head and torso of the patient from the shoulders to the hip, where the load mass of the patient is concentrated. Certain parameters with respect to the load, i.e., weight, patient size and load footprint, are matched to the plenum chamber area, otherwise the unit will not work or work poorly.

The Applicants herein ascertained that an air pallet plenum chamber upon pressurization tends to take a shape resulting in lateral reduction of the plenum chamber air film footprint. Since the patient's body is movable and flexes, this creates significant problems. Not only is such load not rigid, but the top flexible sheet is not a rigid member and, indeed nothing structurally is rigid. Further, only the torso and head is supported by the plenum chamber (i.e., jacked up), and the rest of the body (legs, arms, etc.) simply drag along with the air pallet once an air bearing or air film is created by escape of air through the perforations within the thin, flexible bottom sheet. If the patient has a broken limb, this is not a small problem but a catastrophe. Patient loading on the air pallet and removal from the air pallet produces significant problems. Thus, the ability to create a patient mover having a size to fit the patient, the bed, the portable gurney and a procedure table such as an operating table was quite desirable.

These problems led initially to developments exemplified by U.S. Pat. Nos. 4,528,704 and 4,686,719. However, these developments raised more questions than they provided answers. The key to solving most of the problem areas seemed to lie in the utilization of a rigid backing member, but a rigid backing member made it more difficult to place the patient on the patient mover. The patient has to be physically log-rolled way over, and almost face down to one side so that the rigid backing member is juxtapositioned to the patient, and the patient is then rolled back over so that the patient ends up supine on the patient mover. This procedure follows that of placing the sheet under a patient when on a hospital bed, but than a sheet can be folded in half and slid under the patient without turning his body excessively to one side. Such is not so for a patient mover having a rigid backing member.

Attempts were made for formulating a useful air chamber-type air pallet using a flexible pad to eliminate the rigid backing member. Generally at the same time, the applicants considered the separation of the jacking action from that of creation of the frictionless air film. This led to the development of stacked tubes, one functioning as a pure jacking chamber, and the second as a combined jacking chamber and plenum chamber. The result is a gas pressurized jacking structure with improved load stability, in which the same compressed air pressurizing the upper chamber through a dynamic flowthrough arrangement, functions in passing through the pin hole perforations of the plenum chamber thin, flexible bottom sheet, to create the air film.

In air chamber-type air patient movers, a phenomenon was experienced as the result of air pressurization of the tubular chambers formed by sealed sections of the upper two thin, flexible sheets and the air pressurization of the plenum chamber underlying all of the upper row of tubes common to the intermediate thin, flexible sheet of said row of tubes. The entire unit took on a full vertical circular cross-section and attempted to approach a cylinder, which was termed "hot dogging". During hot dogging, the plenum chamber takes on an almost circular cross-section in a plane at right angles to the longitudinal axis of the series of joined tubes formed by the top thin, flexible sheet, the intermediate thin, flexible sheet and the bottom thin, flexible sheet of the air pallet. A plenum chamber is formed between the thin, flexible intermediate sheet and bottom sheet with the bottom sheet having literally thousands of closely spaced pinholes through which air escapes from the plenum chamber to form an air film or air bearing A between the thin, flexible bottom sheet and the generally rigid, planar surface beneath. Each of the transverse seal lines joining the top and intermediate sheets, which together form individual air pressurizable chambers or tubes, function as hinging areas between adjacent tubes. The result of such hinging is the high instability for any load in contact with the exterior of the top thin, flexible sheet. It is further obvious that the single large sectional area formed by the plenum chamber is without a means for controlling hot dogging and is thus extremely susceptible to this instability problem.

A stable, useful air chamber-type air pallet is further hampered by a phenomenon resulting both in an instability problem and, under severe conditions, a loss or reduction in effective plenum chamber air film or air bearing footprint area to the extent where the air bearing cross-sectional area becomes too small to carry the load, the load may roll off the upper flexible sheet support area as the air pallet assumes a cylindrical shape and the air pallet may ground out as it loses air bearing cross-sectional area, or a combination of all three adverse effects occur.

Another phenomenon which occurs utilizing air chamber-type air pallets is a lack of rigidity of the air chamber assembly defined by the top thin, flexible sheet and the intermediate thin, flexible sheet as a result of air pressurization of all of the chambers of the row of tubes and the air pressurization of the plenum chamber, which underlies the tube array defined by the top and intermediate thin, flexible sheets. While the walls of the individual chambers or tubes are relatively taut, upon air pressurization, the line connections between abutting sides of the parallel row tubes permit tube sectioning lines to act as hinges which cause the unwanted hot dogging of the air pallet. The presence of a load such as a patient and the weight of said patient depressing the upper surface of the air pallet tends to resist the ballooning of the air pallet and enhance the stability of the load. However, such structures inherently lack means for preventing significant lateral shrinking of the plenum chamber.

In view of the lack of rigidity of early air chamber-type air pallets, an investigation of the various causes for suppleness in contrast to desired rigidity (by attempting to substitute an air chamber or chambers for the rigid backing member) led to the determination that rigidity of any part of an air chamber-type air pallet can be achieved from solely two means: varying the air pressure within the various chambers of the air pallet (the result of which tends to create ballooning with the high air pressure found to be undesirable due to the ballooning) and employing a solid unbendable stiff upper sheet supporting the load which, for a point load, spreads such load over the complete surface of the unbendable upper sheet. While the unbendable upper sheet was sufficient to provide rigidity and avoid ballooning in one embodiment of U.S. Pat. No. 4,528,704, the necessary rigidity can only come from the air pressure within, or flowing through, the various chambers of the thin, flexible sheet structure in the embodiment disclosed in FIGS. 4 and 5 of said patent.

In operation of air chamber-type air pallets of the design of U.S. Pat. No. 4,528,704, the plenum chamber being unsectionalized and linked solely to the tubular arrays at opposite ends and along opposite sides of the air pallet, such structure either creates, or enhances, suppleness of the structure which prevents the row of tubes of said air pallet from acting as a substitute for the rigid backing member normally employed in such air pallet structures. This results in hinging between the inflated tubes, ballooning of the structure, creating instability.

In U.S. Pat. No. 5,067,189 entitled AIR CHAMBER TYPE PATIENT MOVER AIR PALLET WITH MULTIPLE CONTROL FEATURES, issued Nov. 26, 1991, the foregoing described problems of over pressurization causing instability of the patient mover and the load, enlargement of the underlying plenum chamber to an almost vertical circular cross-section, i.e. "hot dogging", during pressurization, the requirement for a rigid or semi-rigid backing member to prevent "hinging" between individual longitudinal chambers or tubes for supporting the load, and the point load grounding out on the underlying support surface due to load shifting were tentatively resolved. During the course of improving the earlier air pallet patient movers of the air chamber type, it was found that all of the recited problems with prior types of inflatable air pallets were substantially interrelated, as well as the discovery of an additional structural problem described as the reduction or shrinkage of the lateral dimension of the air pallet. U.S. Pat. No. 5,067,189 reduces the recited problems through a novel interrelated structure. In lieu of a rigid or semi-rigid backing member, a series of stacked rows of pressurized chambers or tubes have been utilized which create a pre-determined air dispersion which, in concert with the air dispersion in the underlying plenum chamber, properly jacks the load, e.g. a patient, and maintains the flexible backing surface (the stacked rows of tubes or chambers) in a planar direction generally parallel to the underlying developed air film. Simultaneously, the plenum chamber is inflated and through the underlying perforations creates an air film between the air pallet and the fixed support surface, but only in an area which generally matches the footprint of the load. Further, the inflation of the plenum chamber within the parameters set forth in U.S. Pat. No. 5,067,189 creates a sufficient pillowing means to permit the air pallet to accommodate surface irregularities and move the load on the developed air film without bottoming out and without the bottom flexible sheet ballooning outward. This is accomplished through a series of vertical and oblique ties which restrain the separation of an intermediate sheet forming the bottom of the linked rows of chambers or tubes and the underlying bottom sheet of the plenum chamber from moving outward one from the other beyond a pre-determined distance. These ties (or stringers) in combination with the stacked rows of chambers or tubes prevent "hot dogging" of the air pallet when inflated, tend to reduce lateral shrinkage of the air pallet because of its anti-hot dogging and anti-ballooning effect, and increase the ability of the air pallet to accommodate surface irregularities when in motion so as not to create a point load problem, all of which increase the load stability of the particular air pallet.

The present invention takes the ongoing development process for the air chamber-type air pallet capable of patient movement to a higher degree of functionality and support without seriously disrupting the continued treatment of a patient. Because the linked array of inflatable air chambers or tubes of U.S. Pat. No. 5,067,189 were longitudinal in direction, the ability to bend or fold the air pallet and continue to support the load once inflated was substantially negated. It was also determined that proper positioning of the patient (the load) centrally on the longitudinal center line of the air pallet was critical in preventing rotational instability. These noted deficiencies, as well as the retention of certain of the described stability requirements, have now been incorporated in an improved air pallet capable of patient movement and treatment.

OBJECTS OF THE INVENTION

It is, thus, an object of the invention to provide improved air dispersion to increase the rigidity of the air chamber-type air pallet during motion to prevent grounding out and to maintain a stable load platform.

It is also an object of the present invention to provide laterally arranged inflatable air chambers or tubes in order to accommodate the folding of hospital beds so as to provide continued therapy for a patient even in a folded posture.

A further object of the present invention is to further reduce lateral shrinkage of the air pallet so that an increased surface area is available to come into contact with the load.

Another object of the present invention is to prevent rotational instability created by mispositioning of the load away from the longitudinal center line by reducing, or almost entirely eliminating, lateral shrinkage of the air pallet.

A still further object of the present invention is to further contour the ties or stringers so as to provide both substantially rigid support during pressurized inflation and movement of the air pallet, increased air dispersion and jacking of the upper support surface for the load, and maintain the anti-hot dogging, anti-ballooning effects of the prior air pallet.

A yet further object of the present invention is to increase load stability through the control of the air flow within the formed tubes or chambers, i.e. the air dispersion, to afford a more uniform jacking of the air pallet with a load in place such that, if such load is a patient, the anxiety from a fear of rolling off the air pallet is significantly reduced as the patient is cradled within the outer chambers during inflation of the air pallet.

Another object of the present invention is to provide continuous therapy to a patient by preventing capillary closure and skin degeneration and by controlling the immediate thermal environment.

Other objects will appear hereinafter.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

DETAILED DESCRIPTION OF THE INVENTION

Figure 1:
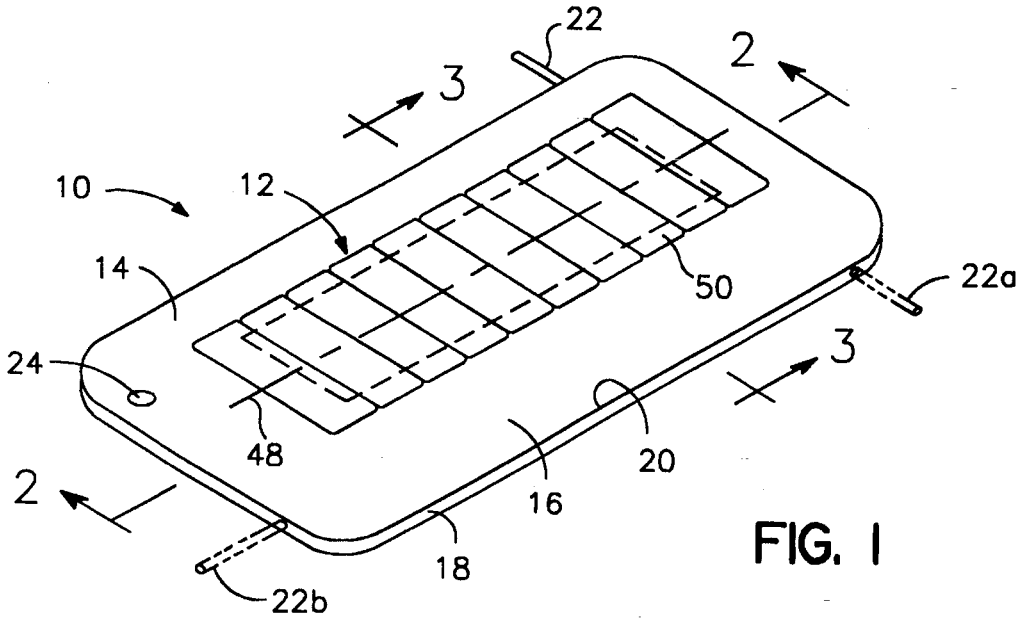
FIG. 1 is an isometric view of a first embodiment of the air chamber-type air pallet of the present invention.

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Referring now to the drawings in detail, where like numerals refer to like parts or elements, there is shown an air pallet 10 of the present invention which is of a different structural configuration than those air pallets which have preceded it. With reference to FIGS. 1 to 4, the air pallet 10 has a series of laterally extending tubes or chambers 12 lying within a continuous rectangular tube or chamber 14. Chambers 12, 14 are formed between a top thin, flexible sheet 16 and a bottom thin, flexible sheet 18. The continuous rectangular chamber 14 is partially formed from the joining of the top and bottom sheets 16, 18 at a peripheral seal line or seam 20 where the two sheets are joined by sewing, thermal welding, or the like. At one or more places along the periphery of the air pallet 10 an air inlet 22 permits air to flow into the pallet 10. Additional air inlets 22*a*, 22*b* (shown in phantom) can be utilized as alternative air inlet sources, or in conjunction with one or more of the air inlets 22. An air exhaust or pressure relief valve 24, while shown as located in the bottom sheet 18 at one end of the rectangular chamber 14, and usually at the end of the air pallet 10 opposite the air inlet 22, such valve 24 may be located at any suitable location in the air pallet 10 so as to properly perform its function in an unimpeded manner.

Figure 3:
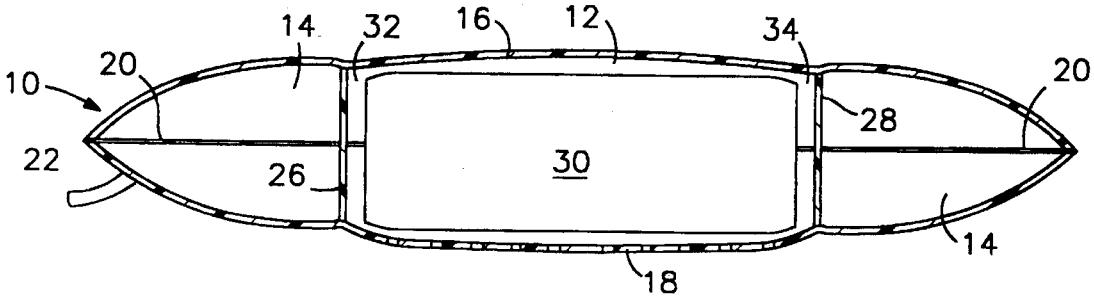
FIG. 3 is a sectional view of the air chamber-type air pallet of FIG. 1 taken along Line 3—3.
Figure 4:
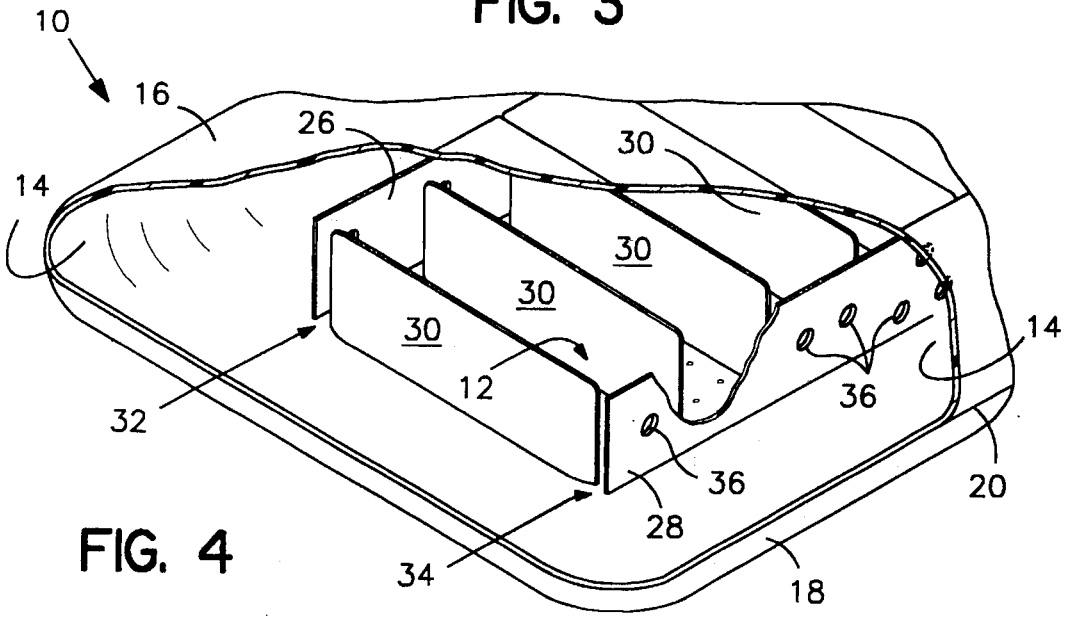
FIG. 4 is an enlarged isometric view of the air chamber-type air pallet of FIG. 1 partially broken away to reveal the internal structural arrangement of the air pallet.
Figure 2:
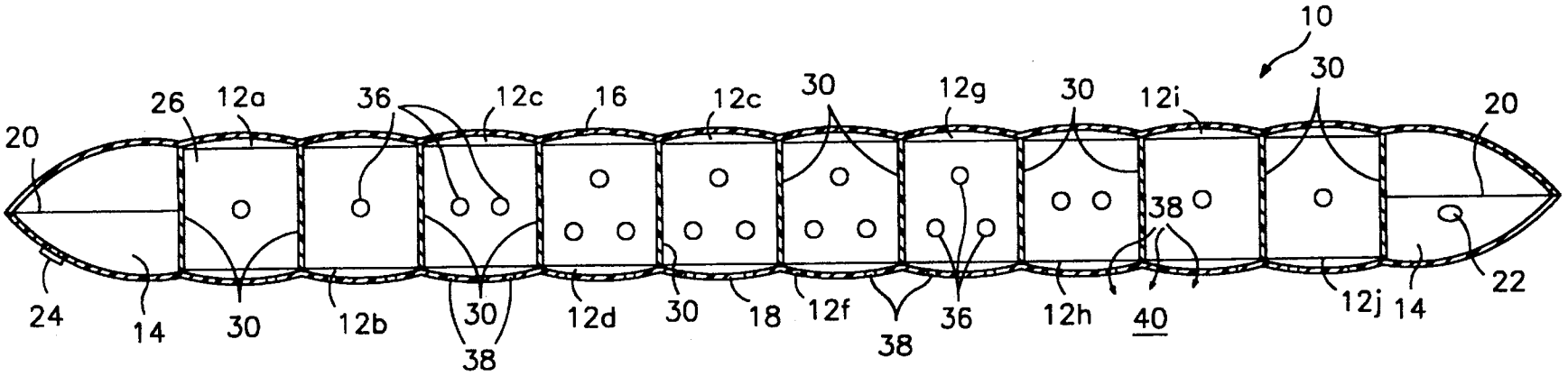
FIG. 2 is a sectional view of the air chamber-type air pallet of FIG. 1 taken along Line 2—2.

As can be seen from FIGS. 2 to 4, the rectangular chamber 14 is comprised of the top and bottom sheet portions joined at the peripheral seal line 20 extending inward to partitioning members 26, 28, which are substantially perpendicular to the top and bottom sheets 16, 18 and joined together by sewing, thermal welding or the like along lines substantially parallel to the longitudinal edges of the air pallet 10. The members 26, 28 separate the rectangular chamber 14 from the lateral chambers 12 along the longitudinal dimension of the air pallet 10.

Identical partitioning members 30 separate each of the chambers 12 from each other and from the rectangular chamber 14 along the transverse or lateral dimension of the air pallet 10. Each of the members 30 are substantially perpendicular to the top and bottom sheets 16, 18 and have tapered ends to permit greater inflation of the central area of the air pallet 10 so as to form a rigid backing member for the load. Each of the members 30 are joined to the top and bottom sheets 16, 18 by sewing, thermal welding or the like along lines substantially perpendicular to those sew lines of members 26, 28.

Although the lateral chambers 12*a*–12*j* are formed from the lateral members 30 and from adjoining portions of the top and bottom sheets 16, 18, the chambers 12*a*–12*j* do not extend completely across the central area of the air pallet 10 between the members 26, 28. See FIGS. 3 and 4. Air dispersion channels 32, 34 exist between the outer extent of the lateral members 30 and the longitudinal members 26, 28. These air dispersion channels 32, 34 permit air to enter the fully deflated and collapsed lateral chambers 12 so as to inflate those chambers, even with a load in position atop the air pallet 10, by jacking, so the load is raised by the inflating chambers 12. Assisting in the air dispersion are a series of apertures or holes 36 placed along the longitudinal dimension of the members 26, 28 in predetermined arrays and positions.

It has been determined that only a single aperture 36 of an approximate size of 0.5 inches in diameter is required at locations where the load is not as heavy, as in the case of a human patient, under the head and legs. Thus, in the positions opposite lateral chambers 12*a*, 12*b*, 12i, and 12*j* only a single aperture was found to be required to assist in air dispersion so that a fairly uniform inflation of the air pallet 10 occurs. Under heavier portions of the load an array of two or more apertures or holes 36 are required for uniform air dispersion and jacking as shown by the arrays at the positions opposite lateral chambers 12*d*, 12*e*, 12*f*, and 12*g*. The arrays of holes 36 shown in FIG. 2 are not dispositive of the exact placement of the holes in the longitudinal members 26, 28, but are only exemplary of the minimum number of holes 36 which are presently believed required to provide for uniform air dispersion resulting in a substantially uniform inflation of the air pallet 10 and jacking of the load. The air dispersion holes 36 may be configured side-by-side in horizontal array, one atop the other in vertical array, diagonally one above the other, or in any other configuration which provides for uniform dispersion into the lateral chambers.

Upon application of air through one or more of the air inlet means 22, the pallet 10 is inflated by having each of the chambers 12*a*–12*j* and 14 inflate from a collapsed position, with the partition members 26, 28 and 30 overlying themselves, to the substantially fully inflated position shown in FIGS. 2, 3 and 4. Both the air dispersion channels 32, 34 and the air dispersion apertures or holes 36 assist in the substantially uniform inflation of the rectangular chamber 14 and the lateral chambers 12*a*–12*j* located in the central area of the air pallet 10.

The foregoing description of FIGS. 1–4 is of one embodiment of the present invention. This embodiment achieves sufficient rigidity by the developing air pressure to achieve the appropriate pillowing effect while simultaneously resisting ballooning, hot dogging and lateral and longitudinal shrinkage of the air pallet 10 through the use of the appropriately positioned partitioning members 26–28 and 30. In furthering the reduction of lateral shrinkage of the air pallet upon inflation of its chambers, lateral partitioning members 30, which extend transversely across the air pallet 10, resist shrinkage along their length dimension (the length of the lateral chambers 12) when inflated due to the dimensional orientation. The rectangular chamber 14 is restricted from expanding beyond a limited height and width due to the placement of the partitioning members 26, 28 and the seal 20 between the top and bottom sheets 16, 18, respectively. The restriction on expansion of the chamber 14 in these dimensions in the end and side positions of the air pallet 10 creates a dimensional control further enhancing the anti-ballooning and anti-hot dogging aspects of the improved structure of the embodiment of FIGS. 1–4. Additionally, this dimensional control significantly further reduces lateral shrinkage across, or in the transverse direction, of the air pallet 10. The placement of the longitudinal partitioning members 26, 28 restrict the expansion of the end portions of the chamber 14 by limiting the height of these end portions of chamber 14 reducing longitudinal shrinkage of the air pallet 10, which will be discussed in greater detail below.

Thus, the formed lateral chambers 12*a*–12*j* constitute a row of thin, flexible sheet material backing chambers of a generally rigid form (when inflated to an appropriate air pressure) to serve as a substitute for any of the foregoing rigid backing members, or for the stacked row of chambers forming a substitute for a rigid backing member of U.S. Pat. No. 5,067,189. The particular placement of the partitioning members 26, 28 cause an increased rigidity for both the lateral chambers 12 and the rectangular chamber 14 when inflated.

Further, with regard to pressure relief valve 24, said valve is designed to automatically self-adjust to maintain the air pressurization of the lateral chambers 12*a*–12*j* and the rectangular chamber 14 of the air pallet 10 at or below a pressure that will substantially prevent capillary closure in any patient. Under such conditions, the patient is considered to be in therapy, and the function of the pressure relief valve 24 is to automatically self-regulate the pressure independently of the weight of the patient (load) with the pressure relief valve 24 preferably set to maintain the pressure which will induce and sustain such therapy. The retention of the air pressurization of the tubes or chambers 12 and 14 prevents capillary closure and breakdown of the skin through loss of blood supply which can develop within a very short period of time due to continuing pressure on the portions of the underside of the body of the patient. The valve 24 is variably adjustable within a range of pressures to select and preset a pressure limit to which the valve will automatically self-regulate. It is also important to note that the chambers 12 and 14 will become near rigid under an air pressure approximating 32 mm of mercury while retaining the patient in circulatory therapy.

The air pallet 10, as described with regard to FIGS. 1–4 up to this point, can be described as an inflatable mattress pad. A modification to this embodiment is the addition of a series of small perforations or inflating fluid escape ports 38 in a specifically designed pattern or array in the bottom sheet 18 substantially configured to be within the footprint of the load. Thus, the array or pattern of perforations or ports 38 would exist below the lateral tubes or chambers 12*a*–12*j* to conform substantially to the footprint of the patient (load). The modified embodiment can now be described as a flow-through mattress pad which is capable of movement of the patient load over substantially flat or slightly irregular rigid underlying surfaces. In this flow-through type patient mover air pallet an air film or bearing 40 is developed beneath the bottom sheet 18 and between said sheet and an underlying support surface. Such air film or air bearing 40 is denoted in FIG. 2 by use of small arrows emanating from the perforations or ports 38 and pointing toward the numeral 40. Such arrows are merely exemplary of the air flow to create the air bearing and would be the case along the entire expanse of the array or pattern of perforations or air escape ports 38 through the bottom sheet 18. However, with this flow-through modification to the air pallet 10, it can no longer be utilized for static patient or load support as the flow-through modification will provide the underlying air bearing 40 which significantly (or almost entirely) reduces the friction between the air pallet 10 and the underlying rigid surface.

Figure 5:
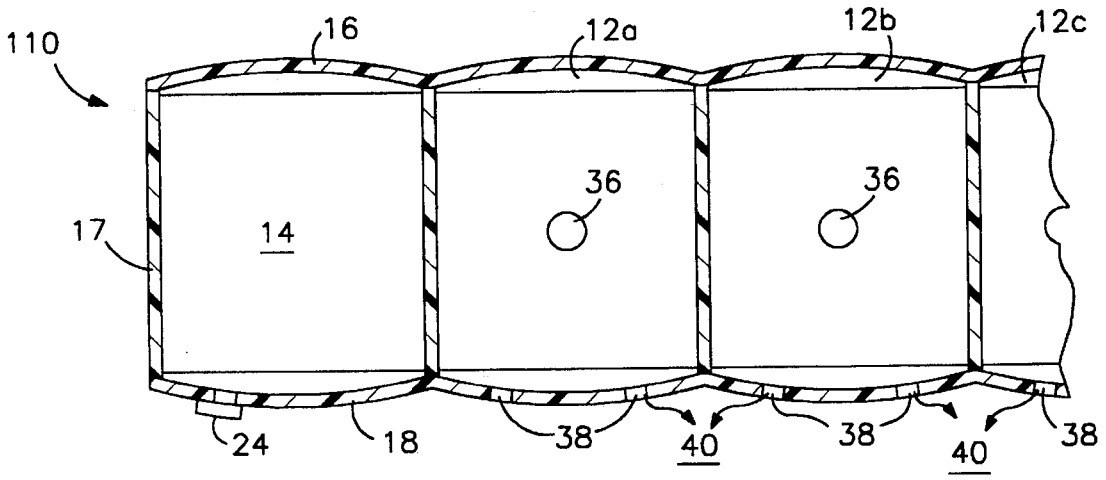
FIG. 5 is a partial longitudinal sectional view of a second embodiment of the air chamber-type air pallet of the present invention showing a vertically expandable external peripheral wall substituted for the peripheral joint or seam.

A second embodiment of the air chamber-type air pallet 10 is shown in FIG. 5. In this embodiment, the air pallet 110, rather than having a peripheral seal line 20, has additional thin, flexible sheet-like material surrounding the periphery of rectangular chamber 14, the peripheral sheet 17 permits a far less stressful expansion of the seams or seal lines between the top sheet 16 and the bottom sheet 18, and also permits the air pallet 110 of the second embodiment to fit within closer proximity to the edges of a patient bed, operating room table, x-ray table, and the like, creating an increased surface area for supporting the load. The seals between the top sheet 16 and the side sheet 17, and between the bottom sheet 18 and the side sheet 17, are not subjected to the same amount of stress as the seal line 20 of the first embodiment. The seals are accomplished at their respective corners where the sheets 16, 18 and 17 are substantially perpendicular one to the other, and may be accomplished by sewing, thermal welding or the like. The usage of the peripheral band 17 further reduces the lateral shrinkage of the air pallet 110 from the earlier versions of air pallets.

As can be seen from the enlarged view of FIG. 5, the bottom sheet 18 has the array of perforations 38, beneath lateral chambers 12*a*, 12*b* and 12*c*. In accordance with the foregoing explanation, the air bearing 40 is established beneath the flow-through type mattress pad of the second embodiment of air pallet 110 and is depicted in FIG. 5 by small arrows emanating from the perforations or escape ports 38 and directed toward the air bearing 40. Thus, the embodiment of air pallet 110 has patient moving capabilities as discussed in connection with the alternate embodiment of air pallet 10 with reference to FIG. 2.

Figure 6:
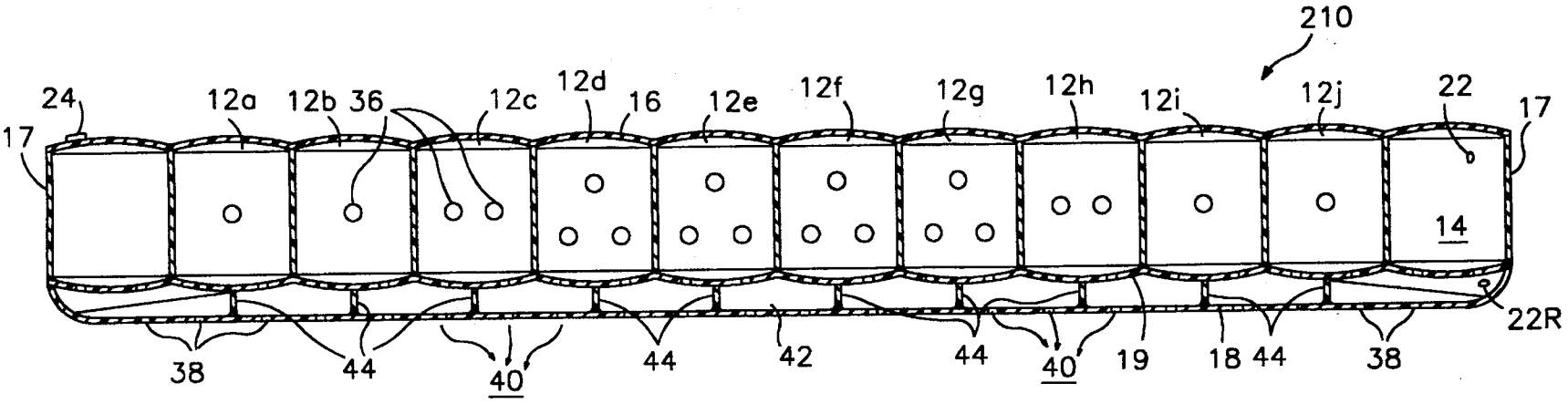
FIG. 6 is a longitudinal sectional view of a third embodiment of the air chamber-type air pallet of the present invention showing patient mover capabilities.

A third embodiment of the air chamber-type air pallet of the present invention is shown in FIG. 6. The air pallet 210 is substantially configured in accordance with the modification to the rectangular chamber 14 set forth in connection with FIG. 5. Thus, the side sheet 17 is shown surrounding the longitudinal sectional view of the air pallet 210. In this embodiment, an intermediate thin, flexible sheet 19 forms the bottom portion of the lateral chambers 12*a*–12*j* and the rectangular chamber 14. Below the intermediate sheet 19 is a plenum chamber 42 which is formed between the intermediate sheet 19 and the bottom sheet 18 by a seal line or seam at the point that the side sheet 17 and the intermediate sheet 19 are joined by sewing, thermal welding, or the like. The separate plenum chamber 42 has been added in the air pallet 210 such that both static and mobile capabilities are imparted to the air pallet of this embodiment. When it is desired for the air pallet 210 to provide static support and therapeutic capabilities as described in connection with the embodiments previously discussed, an inflating fluid is supplied through air inlet means 22 such that the lateral chambers 12*a*–12*j* and rectangular chamber 14 are inflated. Pressure relief valve 24, which now is positioned through the top sheet 16 has a similar purpose to that which has been described above in connection with air pallet 10, only its position is changed to afford the full range of mobility to the underlying plenum chamber 42.

Within the plenum chamber 42, both to prevent lateral and longitudinal shrinkage of the air pallet 210, and to prevent hot dogging, a series of stringers or I-beams 44 are positioned throughout the plenum chamber to permit only a pre-set maximum separation distance between the intermediate sheet 19 and the bottom sheet 18. An I-beam can be considered to be a partitioning wall partially separating one portion of the plenum chamber 42 from another. Additionally, several stringers or I-beams 44 are placed orthodiagonally between the outer underlying corners of the plenum chamber and the intermediate sheet 19. These stringers or ties 44 act, when taut, as a physical restraint system to prevent the structure of the air pallet 210 from hot dogging or ballooning in response to air pressurization of either the lateral chambers 12*a*–12*j* and rectangular chamber 14 above or the plenum chamber 42. A separate air inlet 22*p* provides a means for introducing an inflating fluid, e.g. air, to the plenum chamber 42. As in the earlier described embodiment, an array or pattern of perforations or escape ports 38 through the bottom sheet 18 provides an air flow depicted by small arrows pointing to the created air film or air bearing 40. The area, array or pattern of the perforations 38 coincides substantially with the footprint (cross-sectional area) of the patient (load) which may be supported by the air pallet 210.

As in the case of the earlier described embodiments, the separation of the lateral chambers 12 and rectangular chamber 14 air source from the plenum chamber 42 air source permits the pressure in the upper chambers 12, 14 to be regulated by the pressure relief valve 24 in order to create the appropriate circulatory therapy desired to prevent capillary closure resulting in the breakdown of the skin tissues of a patient remaining in a fixed position for an extended period of time. The air pallet 210 provides an identical automatic maintenance of air pressurization of the upper chambers 12, 14 as described above.

Figure 7:
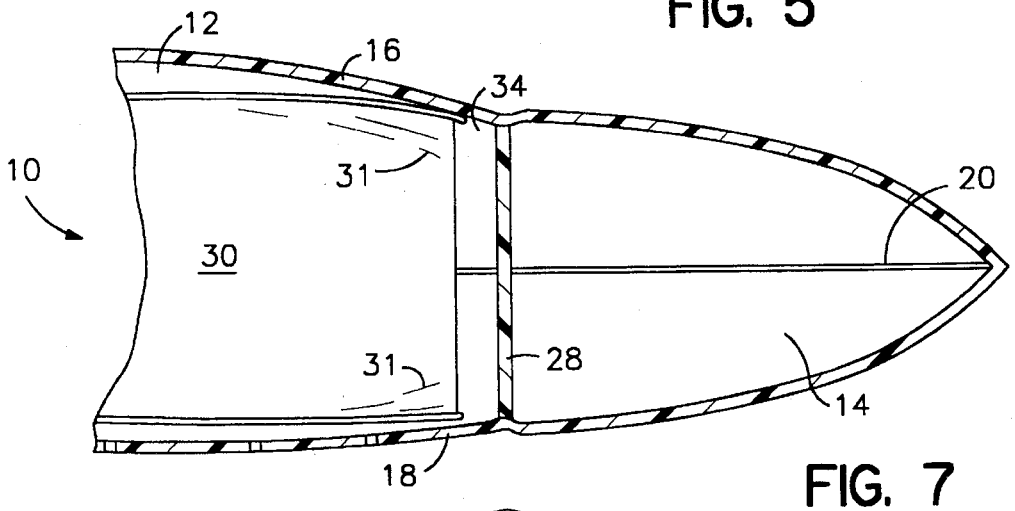
FIG. 7 is an enlarged view of the joint or seam line of FIG. 3 showing the interconnected structure between the lateral and longitudinal chamber walls.

Referring now to FIG. 7, which shows an enlarged view of the side joint or seam of FIG. 3 with a view of the interconnected structure between the lateral and longitudinal chamber walls, one can see that the lateral partitioning members 30 are separated from the longitudinal partitioning member 28 to create the air dispersion channel 34 therebetween. Also of note is the extension of lateral chamber 12, both upwardly and downwardly, beyond the full extension of lateral partitioning member 30 between the seal lines joining the lateral partitioning member 30 with the top sheet 16 and the bottom sheet 18. This arcuate extension of the lateral chamber 12 provides sufficient rigidity of the air pallet 10 (or its alternative embodiment air pallets 110, 210 and the like) to form the necessary rigid backing member to support the patient (load), while simultaneously providing the required therapeutic treatment to patients who may remain in a single position for an extended period of time. In order to accomplish the arcuate extension, while at the same time reducing stress to the sheet material of both the top and bottom sheets 16, 18, the longitudinal partitioning member 28 is of a slightly shorter dimension than the lateral partitioning member 30. In FIG. 7, one can observe that the lateral partitioning member 30 has a slightly greater height than the vertical dimension of the longitudinal partitioning member 28. This significantly reduces the stress experienced by the top and bottom sheets 16, 18 in the area overlying and underlying the air dispersion channel 34 (as well as the air dispersion channel 32, not shown). One should also note that the enlarged view of FIG. 7 exaggerates the dimensional aspects and differences related to the air dispersion channel 34 such that separate elements can be viewed clearly. In permitting the height difference between the lateral partitioning member 30 and the longitudinal partitioning member 28, and considering the proximity of the two partitioning members 30, 28, the lateral partitioning member 30 does not fully extend in the area close to the air dispersion channel 34 creating fold lines 31 at the point juxtaposed to the air dispersion channel 34. As such, the structure is believed to greatly reduce stress on the combined junction of the junctions between and among the lateral partitioning members 30 and the longitudinal partitioning members 26, 28 so as to significantly reduce an internal structural failure of the air pallets 10,110, 210, and the like while retaining the other attributes of the air pallet.

Figure 8:
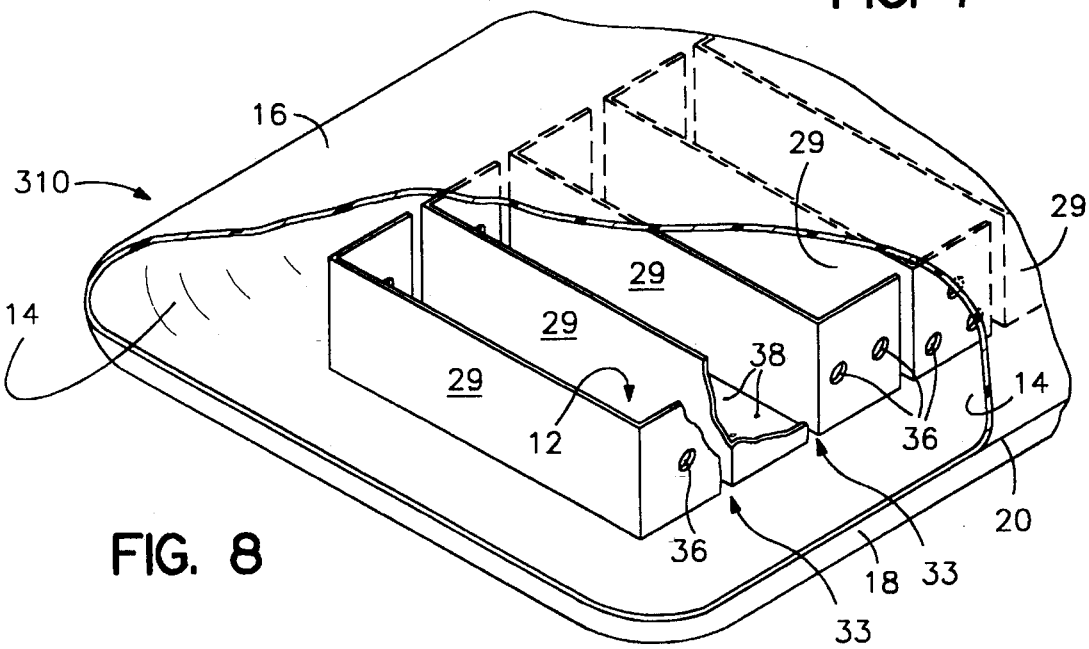
FIG. 8 is an isometric view of a fourth embodiment of the air chamber-type air pallet of the present invention partially broken away to reveal the internal structural arrangement of the air pallet.

Another embodiment of the air chamber-type air pallet of the present invention shows a different configuration for the lateral and longitudinal partitioning members such as that shown in the air pallet 310 of FIG. 8. Rather than the earlier described partitioning members 26, 28 and 30, air pallet 310 reconfigures the partitioning members such that a combined partitioning member 29, having a shape similar to the letter C, extends across the central area of the air pallet 310 and then continues in a perpendicular direction (longitudinally along the rectangular chamber 14) to a position proximate to the next closest combined partitioning member 29 substantially forming a lateral chamber 12 therewithin. Formed between the perpendicular extension of the combined partitioning member 29 and the lateral extension of the next adjacent combined partitioning member 29 are air dispersion channels 33 which serve the identical purpose as the air dispersion channels 32, 34 discussed above in inflating the air pallet and jacking whatever load may be placed upon the air pallet 310. Similarly to the connection of the partitioning members 26, 28 and 30 described above, the combined partitioning member 29 is attached to the top sheet 16 and the bottom sheet 18 by sewing, thermal welding, or the like, but in the case of air pallet 310, simultaneously in both lateral and longitudinal directions.

The combined partitioning or C-shaped members 29, depending upon their exact position, contain air dispersion holes 36 in similar array or configuration to that described in connection with air pallet 10 as shown in FIG. 2. The air dispersion holes 36 serve the identical purpose as previously described and are positioned in accordance with the necessary patterning for providing uniform air dispersion and jacking of the load. The combined partitioning members 29 are capable of folding downward upon themselves by creating a substantially triangular overfold to the perpendicular (longitudinal) extension and then folding down such that the inward facing wall of the combined partitioning member 29 overlays the bottom sheet 18. As in the case of air pallet 10, air pallet 310 may be modified to become a flow-through mattress pad capable of movement of the load through the use of an array of downwardly opening perforations or air escape ports in the bottom sheet 18 in addition to its static capacity as a mattress pad providing therapy to the patient.

Figure 9:
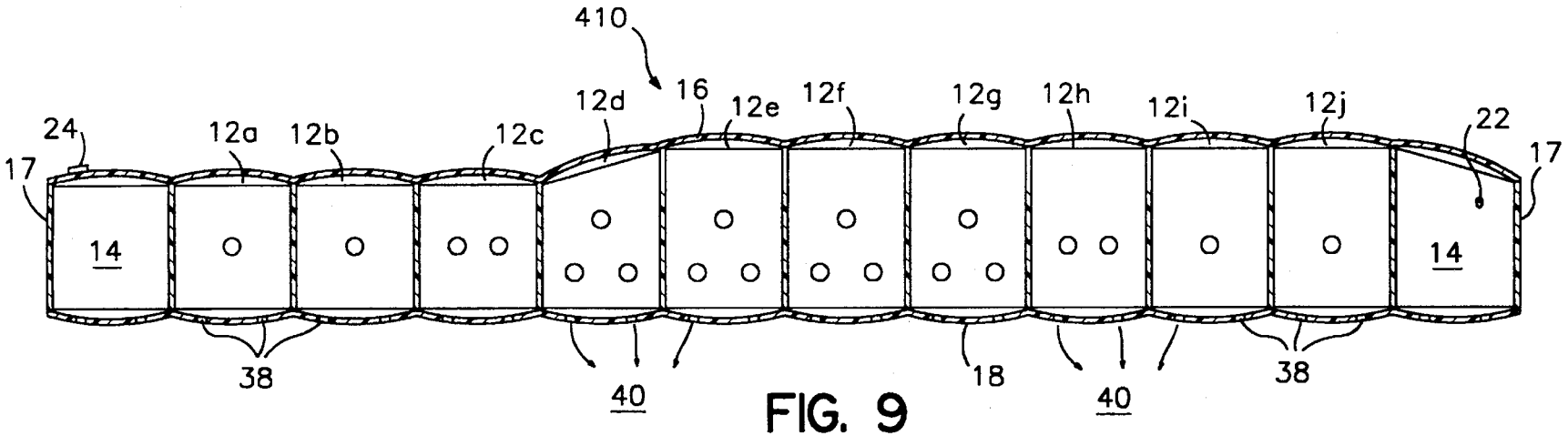
FIG. 9 is a longitudinal sectional view of another embodiment of the air chamber-type air pallet of the present invention showing air chambers of differing heights.
Figure 10:
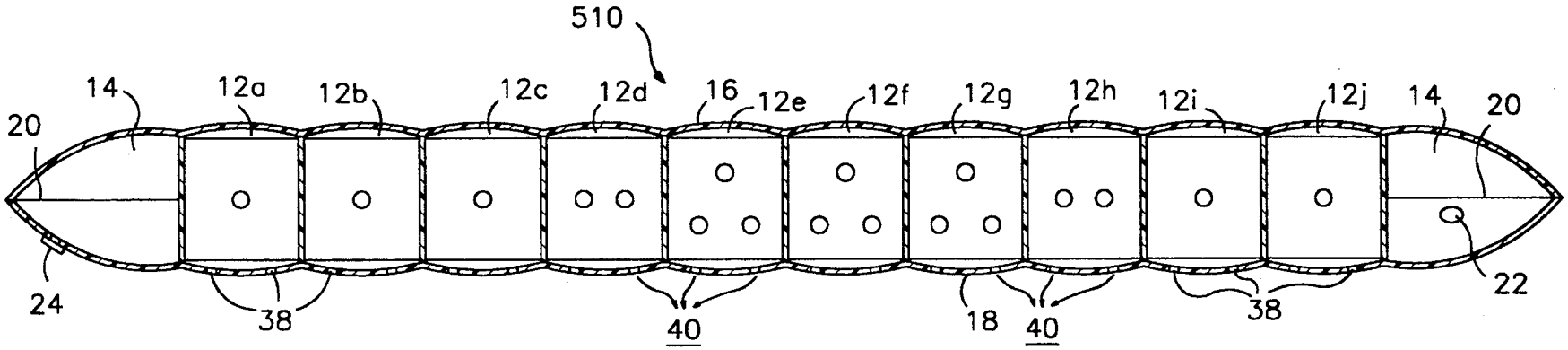
FIG. 10 is a longitudinal sectional view of another embodiment of the air chamber-type air pallet of the present invention showing air chambers of differing widths.

With reference to FIGS. 9 and 10, different embodiments have been developed which provide for additional support for loads with significant weight concentrations in particular locations. With specific reference to FIG. 9, the heights of the lateral chambers 12*a*–12*j* and rectangular chamber 14 have been varied to accommodate the peculiarities of weight dispersion of a patient (load). One can observe that at the left of the figure (indicating the foot of the patient) the portion of the rectangular chamber 14 and lateral chambers 12*a*, 12*b* and 12*c* are of similar height as they support only the legs and feet of the patient. Lateral chamber 12*d* bridges a smaller height to a greater height which exists for lateral chambers through 12*e*–12*j*. The lateral chambers 12*e*–12*j* support the lower and upper torso and arms of the patient which is where the significant weight factor exists. Thus, the increased height of these lateral chambers accommodates the increased weight factor of the load over certain portions of the air pallet 410. The increased height should reduce, if not entirely eliminate, the potential for bottoming out of the air pallet 14 in either a static or mobile configuration if a patient were to be rolled over or roll over on his/her own volition. Further, with significantly heavy patient loads, the increased height of the chamber, giving rise to an increased volume of supporting fluid, produces the required stiffness or rigidity of those lateral chambers 12*e*–12*j* to better stabilize and support the load and provide the necessary rigid backing member. The other portion of the rectangular chamber 14 at the head end of the air pallet 410 is similar to lateral chamber 12*d* and bridges to a decrease in height.

As in the case of air pallet 10, the embodiment shown in FIG. 9 may be static and serve as a mattress pad providing the previously described therapy to the patient in preventing capillary closure and skin breakdown, or be capable of movement by modifying the air pallet 410 to include a pattern of escape ports 38 in bottom sheet 18 to develop an air film or bearing 40 shown by the small arrows pointing to the numeral 40, which are depicted in an exemplary manner as the array of perforations or air escape ports 38 will conform substantially to the footprint of the load under the area defined by chambers 12.

The air pallet 510 of FIG. 10 carries the modifications of the air chamber-type air pallet of the present invention to support significant localized weights by varying the horizontal dimension of individual chambers rather than the vertical dimension as described in connection with air pallet 410 and shown in FIG. 9. The air pallet 510 is of the type described in connection with FIGS. 1–4 having a peripheral seal line 20 extending around the outer perimeter of rectangular chamber 14. In the central area within the rectangular chamber 14, the horizontal dimensions of the lateral chambers 12 are varied to accommodate differing load capacities. At the bottom or foot end of the air pallet 510, lateral chambers 12*a*, 12*b* and 12*c* are slightly downsized in the horizontal dimension as they need only support the lower leg and foot of the patient (load). Under the upper leg of the patient, lateral chambers 12*d* and 12*e* are increased slightly in their horizontal dimension in order to adequately support the increased load of a heavier patient. Likewise, lateral chambers 12*f*, 12*g*, 12*h* and 12*i* are also increased in the horizontal dimension so that the torso of a heavier patient can be adequately supported. Similarly to lateral chambers 12*c* and 12*d* which bridge from lesser width chambers to greater width chambers, lateral chamber 12*j* is slightly decreased in its horizontal dimension as this chamber is only needed to support the shoulders, neck and head portion of the patient. This modification is made such that the air pallet 510 can maintain a rigid backing surface to support the patient in parallel to the underlying support surface. Simultaneously, air pallet 510 also provides the therapeutic pressure control to prevent capillary closure and skin breakdown through the use of the previously described air pressure levels controlled by the pressure relief valve 24. Further, as previously described, air pallet 510 can be modified from a static mattress pad to a movement capable patient mover by the addition of an array of perforations or air escape ports 38 in the bottom sheet 18 which allow the flow-through air to create an air film or bearing 40 underlying the air pallet 510 and denoted (in exemplary fashion) by the small arrows pointing toward the numeral 40. As described in connection with FIGS. 1–4, the air pallet of 510 (similar to air pallet 10) will provide for substantially frictionless movement over flat planar surfaces or an irregular substantially planar surface in order to accomplish movement of the patient while on the air pallet 510.

Figure 11:
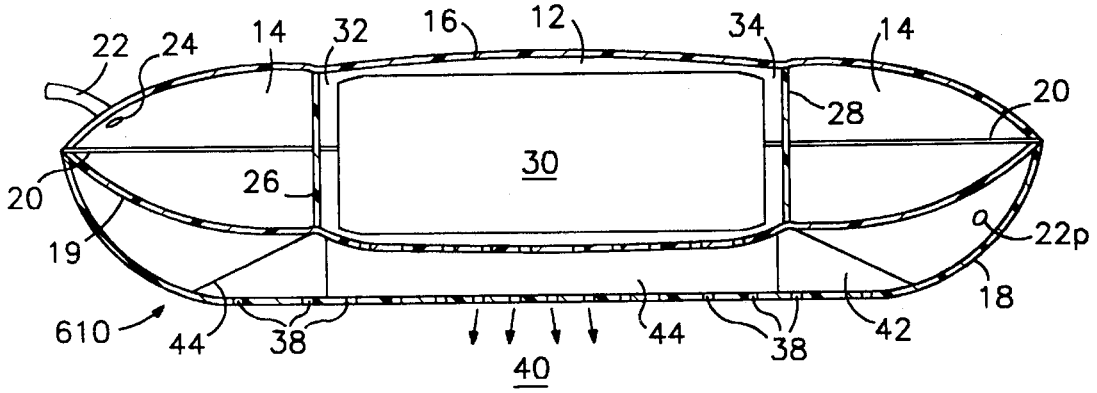
FIG. 11 is a lateral sectional view of another embodiment of the air chamber-type air pallet of the present invention showing an underlying plenum chamber having an array of perforations along the underside for patient mover capabilities.

A still further embodiment of the air chamber-type air pallet of the present invention, as shown in FIG. 11, is a modification to the structure shown and described in connection with FIGS. 1–4. In this embodiment, air pallet 610, a plenum chamber 42 is added below the lateral chambers 12 and rectangular chamber 14 forming the plenum chamber 42 between the intermediate sheet 19 and the bottom sheet 18. As before, a series of appropriately positioned stringers or I-beams 44 throughout the plenum chamber 42 are joined to the intermediate and bottom sheets 19, 18 to limit the separation of the two sheets to a maximum predetermined distance to prevent lateral and longitudinal shrinkage of the air pallet 610, and to prevent hot dogging and ballooning. This configuration permits the control of the air pressure for patient therapy in the upper chambers 12, 14 which is pressurized by fluid entering through air inlet means 22, and which source of pressurizing fluid is kept separate from the air inlet means 22*p* of plenum chamber 42. The plenum chamber can be collapsed (not pressurized) to provide a static mattress pad for air pallet 610 or be pressurized through air inlet means 22*p* such that low pressure or low cfm air is passed through an array of perforations or escape ports 38 located in bottom sheet 18, substantially configured to the footprint of the load (patient), which air exits to create an air film or bearing 40 indicated by the small arrows pointing to the numeral 40.

Figure 12:
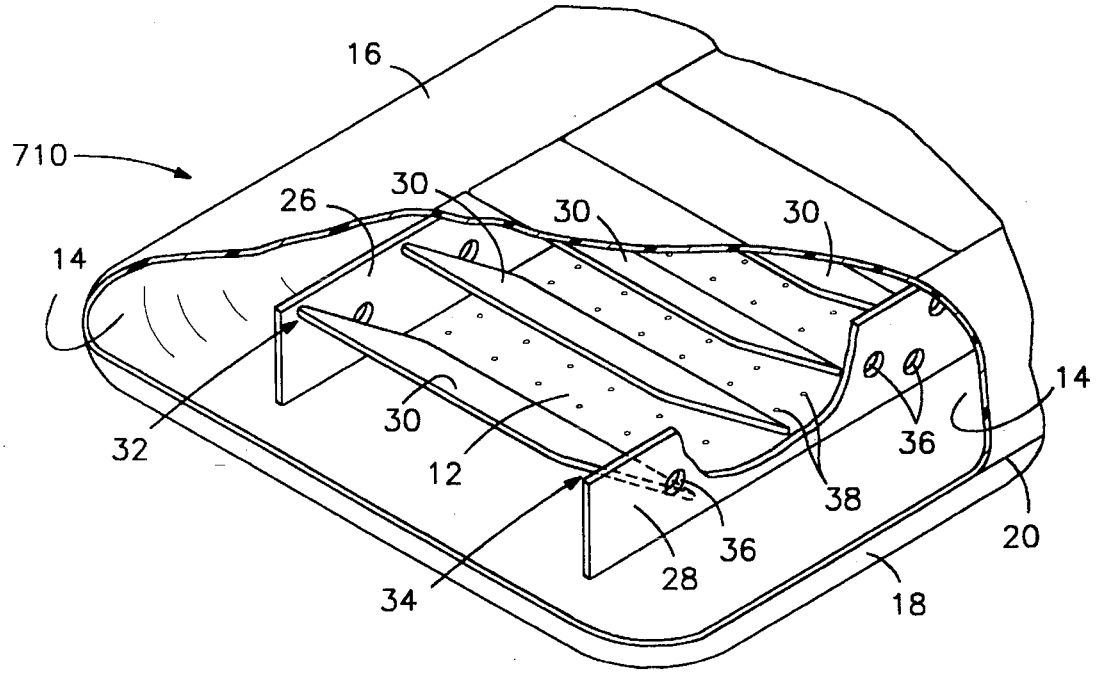
FIG. 12 is an enlarged isometric view of another embodiment of the air chamber-type air pallet of FIG. 1 partially broken away to reveal the internal structural arrangement of the air pallet.

With reference to FIG. 12, a still further embodiment of the air chamber-type air pallet of the present invention is depicted showing a modification in the structure of the lateral chambers 12. In this embodiment, the lateral positioning members 30 are connected to the top and bottom sheets 16, 18, respectively, at offset horizontal positions to permit a non-overlapping collapse of the lateral chamber partitioning members 30 eliminating any bumps or folds in a collapsed air pallet 710 underlying a patient. Thus, the top of the lateral partitioning member 30 is attached to the top sheet 16 by sewing, thermal welding or the like, at a position horizontally offset from the connection of the same lateral positioning member 30 to the bottom sheet 18 by similar methods. The lateral partitioning members 30 are so dimensioned so that overlapping of these members 30 should not occur during normal deflation of the air pallet 710. All of the other structural members and spatial relationships as previously described in connection with FIGS. 1–4 remain the same. Further, the air pallet 710 may be either a static mattress pad having the therapeutic capabilities previously described, or a patient mover air pallet having an array of perforations or escape ports 38 substantially underlying the footprint of the load, i.e. the patient. Additionally, the air pallet 710 may be modified to add a plenum chamber below while simultaneously retaining all of the attributes of the previously described static mattress pad type air pallets.

Figure 13:
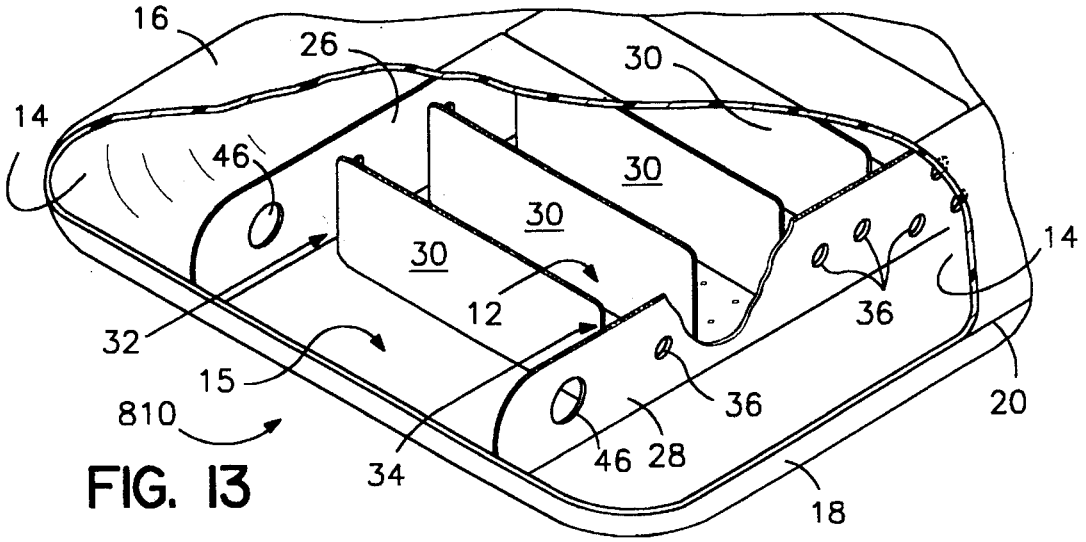
FIG. 13 is an enlarged isometric view of another embodiment of the air chamber-type air pallet of the present invention partially broken away to reveal the internal structural arrangement of the air pallet.

A yet further embodiment of the air chamber-type air pallet of the present invention, as shown in FIG. 13, is a modification to the internal structure shown and described in connection with FIGS. 1–4. In this modified embodiment, air pallet 810, the longitudinal partitioning members 26, 28 are extended to a position adjacent to and to be connected with the thin, flexible top and bottom sheets 16, 18 at both the head and foot ends of the air pallet. Thus, in air pallet 810 the extension of the longitudinal partitioning members 26, 28 creates the formation of two additional lateral chambers 15, one chamber 15 at each of the head and foot ends of the air pallet. The lateral chambers 15 (only the foot end chamber being shown) is dimensioned so that its width is approximately one and one-half times the width of lateral chamber 12 and its length is consistent with the length of the adjacent lateral chamber 12. The height of the lateral chambers 15 will be consistent with the height of the chamber 14 (with regard to the head and foot ends of the air pallets 410, 510, as described in connection with FIGS. 9 and 10) where the vertical dimension is either consistent with the adjacent lateral chamber or is reducing the height, in a bridging fashion, from the adjacent chamber to the height consistent with the height of the chamber at the opposite end.

In extending the length of the longitudinal partitioning members 26, 28 to the head and the foot ends of the air pallet 810, the air dispersion pattern will be interrupted if a means for permitting air flow is not incorporated into the extension portions of the longitudinal partitioning members 26, 28. One such means for permitting continued air flow into the newly formed lateral chambers 15 is an enlarged aperture or hole 46 which provides for a greater volume of air to flow into the head and foot lateral chambers 15 so that uniform air dispersion can occur through the air dispersion channels 32, 34 so that uniform inflation of the air pallet 810 and jacking of any load positioned atop the air pallet can be accomplished. The dimension of the longitudinal partitioning member extension air dispersion holes 46 is larger than the diameter of aperture holes 46 in order to permit the controlled flow of air into the newly formed lateral chambers 15 to begin inflation of the lateral chambers 12 by means of the air dispersion channels 32, 34 in cooperation with the air flow dispersion holes 36 which communicate between the chambers 14 on either side of the air pallet 810 and the lateral chambers 12 occupying the area between the chambers 14. In this configuration Applicants believe that a single air inlet 22 will be sufficient, but that plural air inlets 22 positioned for fluid pressurization into each of the longitudinal chambers 14 will provide for a better controlled, balanced air inflow to the air pallet permitting a more uniform inflation and jacking.

The modification of the air pallet 810 to extend the length of the partitioning members 26, 28 to form additional chambers 15 introduces a further advantage in that the shrinkage of the air pallet is reduced in the longitudinal direction. Therefore, the steps undertaken to reduce the lateral shrinkage across the air pallet also apply to this characteristic. The longitudinal partitioning members 26, 28 reduce longitudinal shrinkage of the air pallet by creating a dimensional restriction or control in limiting the height to which chambers 14 may expand when inflated. This also provides effective anti-ballooning and anti-hot dogging control of these chambers, and of the air pallet overall. The extended longitudinal partitioning members 26, 28, which form chambers 15 at the head and foot of the air pallet 810, further reduce the longitudinal shrinkage of the air pallet by further limiting the height to which chambers 15 may expand, further reducing the longitudinal shrinkage of the air pallet 810. The additional structure of the chambers 15 also further prevents ballooning and hot dogging of the air pallet.

The air pallet 810 can be modified to include an array of perforations or air escape ports 38 in the bottom sheet 18 so that the static mattress pad can be converted into a flow-through patient mover air pallet having the characteristics and attributes of the various embodiments described above. As in the case of the other embodiments, the array or configuration of escape ports is restricted to underlie the footprint of whatever load is aboard air pallet 810 which footprint is generally restricted to the area which directly underlies the lateral chambers 12. All of the other structural members and spatial relationships as previously described in connection with the various foregoing embodiments are applicable to this embodiment. Further, the air pallet 810 may be modified to add a plenum chamber below, as shown and described in connection with FIG. 11, while simultaneously retaining the therapeutic attributes and patient mover attributes of the previously described air pallets.

Figure 14:
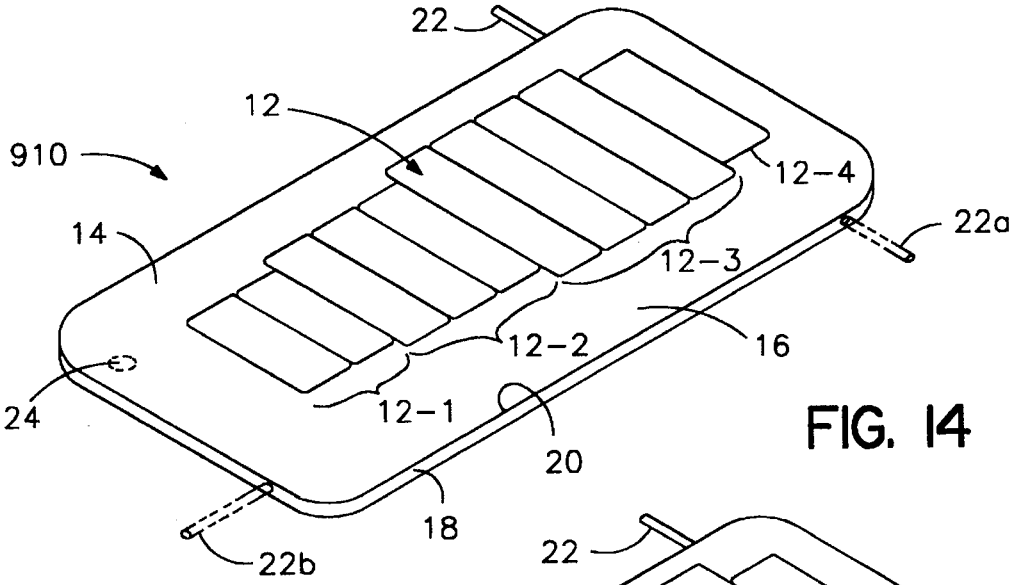
FIG. 14 is an isometric view of another embodiment of the air chamber-type air pallet of the present invention showing lateral air chambers with differing lengths wherein said chambers are arrayed in a configuration of the footprint of the patient load to underlie, support and stabilize the load.

A still further embodiment of the air chamber-type air pallet of the present invention, as shown in FIG. 14, is a modification to the structure of the lateral chambers shown and described in connection with FIGS. 1–4, 7 and 11. In this embodiment, air pallet 910 is modified such that the length of the lateral chambers 12 is varied to provide additional support and stability of the load, in this case, a patient. The two lateral chambers closest to the foot of the air pallet 910 may be reduced in length such that the adjacent rectangular chamber 14 increases in width such that the cradling effect to the load increases. As the two lower lateral chambers 12 need only support the lower leg and feet of the patient the reduction in length does not decrease the effective rigidity when these chambers are inflated, even in the case of a heavier patient. Thus, the lower lateral chambers 12-1 can be reduced in length without any diminishing of the effectiveness of the substantially rigid support afforded to the load while simultaneously gaining the effect of a greater cradling effect by increase in the width of the outer rectangular chamber 14.

The next adjacent lateral chambers, which are three in number, and which are depicted as chambers 12-2, remain substantially of the same length as that described in connection with the lateral chambers 12 of FIG. 1. This is because the upper leg section of even a heavier patient is believed to require only the support required by those chambers 12-2 having the substantially similar dimensional length as that normally provided for any load. Thus, the lateral chambers 12-2 are retained in substantially the same length dimension as that previously described, which still provides a cradling effect from the adjacent longitudinal portion of the chamber 14.

The next adjacent lateral chambers (being four in number), which are depicted as lateral chambers 12-3, each have an extended length laterally or transversely across the air pallet 910 to accommodate the increased side-to-side dimension of the human torso and arms of the intended patient load. The increased lateral dimension of lateral chambers 12-3 provide for greater stability to the patient without decreasing the cradling effect of the chamber 14 on either side of the chambers 12-3. The increase in the length of the lateral chambers 12-3 does not effect the rigidity of the upper surface providing the support for the patient load.

The upper lateral chamber 12-4 retains the length dimension of those chambers depicted as 12-2 as the neck and head of any patient does not require the increased lateral dimension of the lateral chambers 12-3. In all cases, with the exception of the transverse dimension of the lateral chambers 12, the longitudinal partitioning members 26, 28 follow the lateral external dimensions of the chambers 12 such that the air dispersion channels 32, 34 conform to the changes in lateral dimension of the chambers 12 which simultaneously change the width dimension of the longitudinal portions of the chamber 14. The foregoing is merely exemplary of one of many different configurations for varying the support provided by the air pallet for a given load.

Alternatively, the chambers 12 may be formed such that their respective lengths differ as described in accordance with the teachings relative to the C-shaped lateral chambers of air pallet 310 shown in FIG. 8. All of the other structural members and spatial relationships as previously described in connection with the foregoing figures remain the same. The air pallet 910 may also be either a static mattress pad having the therapeutic capabilities previously described to prevent capillary closure and skin breakdown, or a patient mover air pallet having an array of perforations or air escape ports 38 substantially underlying the footprint of the load, i.e. the patient.

Figure 15:
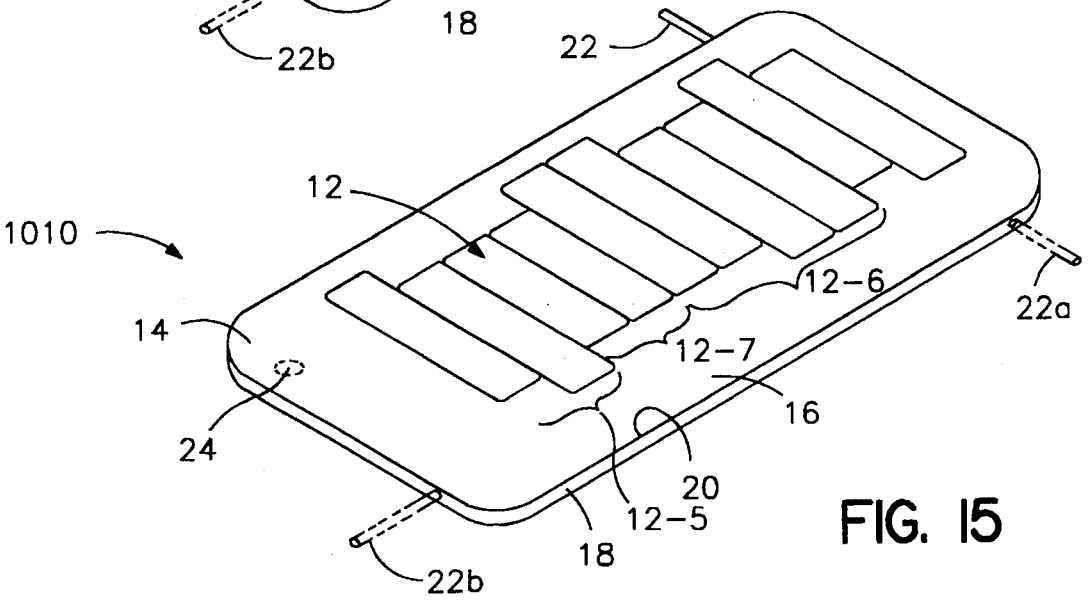
FIG. 15 is an isometric view of another embodiment of the air chamber-type air pallet of the present invention showing lateral air chambers of differing lengths wherein said chambers are arrayed in a configuration such that the lateral air chambers extend outward to support and stabilize the load.

A yet further embodiment of the air chamber-type air pallet of the present invention, as shown in FIG. 15 wherein there is a modification to the structure shown and described in connection with FIGS. 1–4, 7 and 11, as well as FIG. 14. In this embodiment, air pallet 1010 provides for differing lengths of the lateral chambers 12 such that one or more of the lateral chambers have an outward extension toward one of the sides of the air pallet 1010 as shown in FIG. 15. The bottom two lateral chambers 12, depicted as lateral chambers 12-5, have extensions which alternately extend toward the opposite sides of the air pallet 1010. Alternatively, instead of alternating adjacent chambers having extensions toward opposite sidewalls of the air pallet 1010, adjacent lateral chambers 12 can jointly extend towards the same side while the next two adjacent lateral chambers 12 extend towards the opposite side as depicted in the series of lateral chambers identified as 12-6. Also, within the same central area 12 defined by the chambers 12 for supporting the patient or load, the lateral chambers 12 may be retained in their original dimensional configuration (as depicted by the chambers identified as 12-7) lying between other lateral chambers which have extensions toward opposite sides of the air pallet 1010.

As in the case of the other embodiments of the air pallets, all of the other structural members and spatial relationships as previously described in connection with those embodiments remain the same, with the exception that the longitudinal partitioning members 26, 28 again substantially conform to the extensions to provide the narrow air channel for uniform air dispersion to each of the lateral chambers 12. The chambers 12 may be formed as described in connection with FIG. 8 in a C-shape to simplify construction of the air pallet. The air pallet 1010 may also be either a static mattress pad having the therapeutic capabilities previously described, or a patient mover air pallet having an array of perforations or air escape ports 38 substantially underlying the footprint of the load. Additionally, the air pallet 1010 may be modified to add a plenum chamber below while simultaneously retaining all of the other attributes of the previously described air pallets.

One of the significant deficiencies experienced when working with the air pallet of U.S. Pat. No. 5,067,189 was the instability of the load when improperly placed on the pallet prior to inflation. If the load was not substantially positioned along the longitudinal center line of the patient mover type air pallet, or positioned centrally on other air pallets, the load could be subjected to a rotational instability as the air pallet was inflated and jacking of the load occurred. If a patient (load) was not so positioned, uneven jacking would likely occur and "catapult" the patient (load) off the air pallet by rotating the load about its gravimetric center so that the load would also tend to roll or slide off the air pallet. For example, if a patient (load) is placed on the air pallet so that the patient's center of gravity (usually the center line or point of the load) is spaced away from the center line or point of the air pallet to one side with the patient (load) occupying only one half of the air pallet support surface, when inflation occurs the patient (load) would tend to rotate outward due to increased weight in one area of the air pallet causing the air pallet to unevenly inflate (jack) creating a pronounced tilt in the supporting surface for the load. The tilt or incline in the support surface for the patient (load) creates a rotational instability for the patient (load) causing the load to roll or slide off the air pallet, or move out of position on the air pallet.

The present invention, in each of its embodiments, creates an environment wherein the dispersion pattern of the inflating fluid causes a more even jacking, particularly when a patient (load) is positioned on the air pallet. The lateral chambers 12 (and the lateral chambers 15) create a much broadened fulcrum area or plane in the support surface for the load. In earlier versions of the air pallet, such as the array of stacked tubes in U.S. Pat. No. 5,067,189, the fulcrum (or pivot) line usually occurred along the center line of the air pallet. With a patient (or load) positioned to one side of the center line, the effect is similar to a lever arm and fulcrum extending along the plane of the center line causing a rotational instability due to the position of the load exerting its weight downward on to only a portion of the air pallet resulting in the uneven jacking as inflation occurs. In the present invention the lateral chambers 12 (and 15) create an extended fulcrum area or plane (as surrounded by the longitudinal chamber 14) such that the pivot line is broadened to substantially the entire dimensional length of the lateral chambers relative to the position of the load. Thus, even if a patient (load) is positioned away from the center line 48 of an air pallet such as shown in FIG. 1, the structural interrelationship of the chambers 12 and 14 in conjunction with the better controlled dispersion of the inflating fluid causes substantially even jacking across the air pallet significantly reducing previously encountered rotational instability. This is due to the fulcrum plane 50 (shown in dotted line) extending outward from the center line of the air pallet to at least the gravimetric center (center of gravity) of the load to encompass, substantially, the footprint of the load. Upon inflation, the load is jacked evenly in an upward direction without tipping or tilting caused by an uneven downward force exerted by a mispositioned load. This description applies to the structure of each of the embodiments of the present invention presented above, such as in FIGS. 4, 8, 11 and 12–15, and is further enhanced by the anti-lateral and anti-longitudinal shrink features also described above.

In connection with the flow through air pallets described in connection with the various embodiments of the present invention, it has been determined that the pressure of the inflating fluid during transfer (movement) of the patient (load) remains below the recommended pressure of 32 mm of mercury preventing capillary closure and skin breakdown of a patient. Thus, circulatory therapy of a patient is maintained during transfer without the need for the valve 24.

It has also been discovered that an environmental temperature increase occurs as the volumetric flow of air is circulated throughout both a static mattress and a flow through type air pallet. A warming of the load on the air pallet occurs by heat conductance through the top sheet 16 of the air pallet. In a static mattress type air pallet, the valve 24 may not be regulated to permit a flow of air through the air pallet to achieve the warming effect described. In a flow through type air pallet, warming of the surrounding air may occur from air, which has been warmed through pressurization within the air pallet, escaping through the pattern of perforations 38 in the bottom sheet 18 and rising outside and adjacent to the sides of the air pallet to warm the environment around the patient or load. Thus, a patient may receive additional therapy by the flow of air through the air pallet, and by the flow of air exiting the air pallet and rising alongside it, as such affects the surrounding environment.

Thus, the various embodiments of the present invention eliminate the need for a stacked array of air tubes or chambers to provide sufficient rigidity to support the patient or load. The present invention also provides longitudinal outer chambers which are sufficiently flexible to be folded to permit the flexure or folding of the air pallet not provided for in any of the teachings of the referenced patents. The flexure of the air pallet to conform to an underlying support surface, a folded bed, is not due to hinging, but due to a partial restriction in the inflation of adjoining lateral chambers without any reduction in the support of the load. Further, the outer chamber encircling the lateral chambers is also capable of flexure due to its width/height dimensions which permit the partial restriction of its fully inflated expansion to accommodate a specific underlying support surface such as a folded or inclined bed. The outer chamber 14 accommodates the fold or incline by contouring to the underlying surface by partially restricting the full inflation expansion of the chamber immediately adjacent to the folded surface. This flexure of the air pallets of the present invention, regardless of structural configuration, is possible while continuing to prevent bottoming out due to a point load which may be exerted against the air pallet.

In combining the lateral chambers 12 with the rectangular chamber (or longitudinal chamber) 14 (as well as by the addition of lateral extension to the length dimension of the lateral chambers 12) both the stability of the load on the air pallet has been enhanced and the anxiety of the patient has been reduced due to the increase in rotational stability of the load through the broadening of the fulcrum area or plane across the air pallet. Further, by modifying the length, width and/or height of the lateral chambers has afforded to the air pallet the increased ability to support heavier loads at pre-determined locations on the air pallet. Additionally, the internal structural arrangement of elements separating the lateral chambers from the longitudinal outer chamber significantly reduces the pressure stress on the joints between and among the longitudinal and lateral partitioning members and the adjacent top and intermediate or bottom sheets, while simultaneously providing plural air dispersion channels for a more controlled and uniform air flow for inflation of the air pallet and jacking of any load positioned atop a deflated pallet.

Further, the present invention has been tested to function as a 2-sheet air pallet as both a static mattress pad and as a flow-through patient or load mover. The present invention has also been tested to function as a 3-sheet static mattress pad with the underlying incorporated plenum chamber deflated and as a patient or load mover with the plenum chamber inflated.

All of the embodiments retain the ability to maintain the pressure in the air pallet against a patient load within the range to therapeutically prevent capillary closure and skin breakdown or degradation through loss of blood circulation while simultaneously maintaining an appropriate rigidity for sufficient support of the load preventing point load grounding on an underlying supporting surface.

The present invention also provides for a significant reduction in both lateral and longitudinal shrink of the supporting surfaces, and the air pallet in general, such that a greater surface area is provided for the support of the patient or the load. Additionally, the stability of the load is enhanced by varying the dimension of the lateral support chambers in the transverse direction such that extensions of these chambers outward from a central area of the air pallet increase lateral and rotational stability. The stability of the load is also greatly enhanced by the structural interrelationship of the rectangular or longitudinal chambers encircling the lateral chambers. And, due to certain structural modifications, for example the longitudinal partitioning members extensions being one such modification, significantly reduces longitudinal shrinkage of the air pallet which increases the area of the supporting surface for the load.

All of the foregoing described improvements in the form of modifications to earlier air pallet designs and structures can be accomplished while still providing the continued therapy to the patient without any effect on the ability to create and maintain an air film or air bearing below the air pallet to afford the substantially frictionless movement of the air pallet across any underlying planar (or irregular) surface to transfer the patient or load on the air pallet from one location to another. This continues to be so even in a flow through type air pallet where it has been discovered that the pressure of the inflating fluid inside the air pallet remains below the pressure which, if exceeded, could cause capillary closure and skin degradation while maintaining the air film or air bearing for frictionless load transfer.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

We claim:

1. An inflatable flexible pallet comprising:

first and second generally rectangular, elongated sheets connected together at peripheral edges thereof, the connected sheets defining an inflatable main cavity therebetween, the main cavity having a longitudinal axis and a lateral axis;

inlet means for communicating a pressurized fluid into the main cavity whereby the main cavity is inflated;

a generally rectangular array of chambers formed within the main cavity, the array including a plurality of side-by-side, laterally extending, elongated chambers formed by a plurality of spaced apart partition members having laterally extending portions and longitudinally extending portions attached to the first and second sheets, the longitudinally extending portions being at opposed ends of the laterally extending chambers;

the array of chambers being spaced from, and framed within the peripheral edges by a continuous rectangular chamber including a pair of opposed, laterally extending end portions and a pair of opposed, longitudinally extending side portions; and means for permitting fluid introduced into the inlet means, under pressure to communicate freely throughout the main cavity including the end and side portions of the rectangular chamber and the array of chambers, the laterally extending portions of the partition members have an edge attached to the first sheet and an opposite edge attached to the second sheet, the attachments being offset so that when the pallet is inflated, the laterally extending portions of the partition members include an arcuate extension as each extends to a substantially taut vertical position between the sheets, whereby an increased load support surface area is provided through reduction of shrinkage of said pallet in the transverse direction to both of said lateral and longitudinal axes.

2. The pallet as defined in claim 1, wherein the longitudinally extending portions of the partition members have an edge attached to the first sheet and an edge attached to the second sheet so that when the pallet is inflated, the longitudinally extending portions of the partition members are extended to a substantially taut vertical position between the sheets.

3. The pallet as defined in claim 2, wherein the means for permitting fluid introduced into the inlet means to communicate freely throughout the main cavity includes a plurality of apertures formed in the longitudinally extending portions of the partition members.

4. The pallet as defined in claim 2, wherein the means for permitting fluid introduced into the inlet means to communicate freely throughout the main cavity further includes the longitudinally extending portions of the partition members being free of attachment with the laterally extending portions of the partition members.

5. The pallet as defined in claim 1, wherein the laterally and longitudinally extending portions of the partition members are integrally formed into a C-shaped partition member having an edge attached to the first sheet and an edge attached to the second sheet so that when the pallet is inflated, the C-shaped partition member is extended to a substantially taut vertical position between the sheets.

6. The pallet as defined in claim 5, wherein the means for permitting fluid introduced into the inlet means to communicate freely throughout the main cavity includes a plurality of apertures formed in the longitudinally extending portions of the C-shaped partition member.

7. The pallet as defined in claim 5, wherein the means for permitting fluid introduced into the inlet means to communicate freely throughout the main cavity further includes each C-shaped partition member being free of attachment to an adjacent C-shaped partition member.

8. The pallet as defined in claim 1, when used as a therapy or treatment device, further comprising:

valve means for automatically maintaining a pressure within the pallet, when inflated, to prevent capillary closure and skin degeneration through loss of circulation.

9. The pallet as defined in claim 1, when used as a therapy or treatment device, further comprising:

means for permitting a predetermined volumetric flow of inflating fluid to circulate through said pallet to achieve an environmental temperature increase by the conductance of heat from the contained, pressurized inflating fluid through the first sheet underlying the load to warm the load.

10. The pallet as defined in claim 1 further comprising:

means for decreasing rotational instability about the longitudinal center line of the pallet, said means being the extension outward of a fulcrum plane from the center line, said fulcrum plane generally defined by said elongated chambers and substantially encompassing the footprint of the load.

11. The pallet as defined in claim 1 further comprising:

means for increasing the stability of the pallet, said means being a perimeter band placed intermediate of and interconnecting the first and second sheets at the peripheral edges thereof.

12. The pallet as defined in claim 1, wherein one or more of the partition members vary in size from others of the partition members, so that when the pallet is inflated, the distance between the first and second sheets where attached to the partition members varies so that the load supporting capability of portions of the pallet becomes variable.

13. The pallet as defined in claim 1, wherein the spacing between one or more of the laterally extending portions of the partition members and others of the laterally extending portions of the partition members varies so that the load supporting capability of portions of the pallet becomes variable.

14. The pallet as defined in claim 1, wherein one or more of the laterally extending, elongated chambers vary in length from others of said chambers such that one or more of said chambers have portions extending farther laterally outward than the others of said chambers to enhance the load supporting capability of the pallet by increasing stability of said pallet.

15. The pallet as defined in claim 1, wherein one or more of the laterally extending, elongated chambers vary in length from others of said chambers such that one or more of said chambers have portions which do not extend beyond the others of said chambers to enhance the load supporting capability of the pallet.

16. An inflatable, flexible pallet for frictionless movement of a load on an underlying, substantially planar support surface comprising:

top and bottom generally rectangular, elongated sheets connected together at peripheral edges thereof, the connected sheets defining an inflatable main cavity therebetween, the main cavity having a longitudinal axis and transverse axis;

inlet means for communicating a pressurized inflating fluid into the main cavity whereby the main cavity is inflated;

a generally rectangular array of chambers formed within the main cavity, the array including a plurality of side-by-side, laterally extending, elongated chambers formed by a plurality of spaced apart partition members having laterally extending portions and longitudinally extending portions attached to the top and bottom sheets, the longitudinally extending portions being at opposite ends of the lateral extending chambers;

the array of chambers being spaced from, and framed within the peripheral edges by a continuous, rectangular chamber including a pair of opposed, laterally extending end portions and a pair of opposed, longitudinally extending side portions;

means for permitting the inflating fluid introduced into the inlet means, under pressure, to communicate freely throughout the main cavity including the end and side portions of the rectangular chamber and the array of chambers; and the bottom sheet including a portion, substantially defined by the array of chambers, having a plurality of closely spaced, small inflating fluid escape ports opening directly into the main cavity, whereby when the main cavity is inflated, the inflating fluid therein flows through the ports to create a thin film between the bottom sheet and the support surface and, whereby an increased load support surface area is provided through reduction of shrinkage of said pallet in the transverse direction to both of said lateral and longitudinal axes.

17. The pallet as defined in claim 16, wherein the laterally extending portions of the partition members have an edge attached to the top sheet and an opposite edge attached to the bottom sheet so that when the pallet is inflated, the laterally extending portions of the partition members are extended to a substantially taut vertical position between the sheets.

18. The pallet as defined in claim 17, wherein the longitudinally extending portions of the partition members have an edge attached to the top sheet and an edge attached to the bottom sheet so that when the pallet is inflated, the longitudinally extending portions of the partition members are extended to a substantially taut vertical position between the sheets.

19. The pallet as defined in claim 18, wherein the means for permitting fluid introduced into the inlet means to communicate freely throughout the main cavity includes a plurality of apertures formed in the longitudinally extending portions of the partition members.

20. The pallet as defined in claim 18, wherein the means for permitting fluid introduced into the inlet means to communicate freely throughout the main cavity further includes the longitudinally extending portions of the partition members being free of attachment with the laterally extending portions of the partition members.

21. The pallet as defined in claim 16, wherein the laterally extending portions of the partition members have an edge attached to the top sheet and an opposite edge attached to the bottom sheet, the attachments being offset so that when the pallet is inflated, the laterally extending portions of the partition members include an arcuate extension as each extends to a substantially taut vertical position between the sheets.

22. The pallet as defined in claim 21, wherein the longitudinally extending portions of the partition members have an edge attached to the top sheet and an edge attached to the bottom sheet so that when the pallet is inflated, the longitudinally extending portions of the partition members are extended to a substantially taut vertical position between the sheets.

23. The pallet as defined in claim 22, wherein the means for permitting fluid introduced into the inlet means to communicate freely throughout the main cavity includes a plurality of apertures formed in the longitudinally extending portions of the partition members.

24. The pallet as defined in claim 22, wherein the means for permitting fluid introduced into the inlet means to communicate freely throughout the main cavity further includes the longitudinally extending portions of the partition members being free of attachment with the laterally extending portions of the partition members.

25. The pallet as defined in claim 16, wherein the laterally and longitudinally extending portions of the partition members are integrally formed into a C-shaped partition member having an edge attached to the top sheet and an edge attached to the bottom sheet so that when the pallet is inflated, the C-shaped partition member is extended to a substantially taut vertical position between the sheets.

26. The pallet as defined in claim 25 wherein the means for permitting the inflating fluid introduced into the inlet means to communicate freely throughout the main cavity includes a plurality of apertures formed in the longitudinally extending portions of the C-shaped partition member.

27. The pallet as defined in claim 25, wherein the means for permitting fluid introduced into the inlet means to communicate freely throughout the main cavity further includes each C-shaped partition member being free of attachment to an adjacent C-shaped partition member.

28. The pallet as defined in claim 16, when used as a therapy or treatment device, further comprising:

valve means for automatically maintaining a pressure within the pallet, when inflated, to prevent capillary closure and skin degeneration through loss of circulation.

29. The pallet as defined in claim 16, when used as a therapy or treatment device and configured as a flow through air pallet, further comprising:

means for automatically maintaining a pressure within the pallet, when inflated, to prevent capillary closure and skin degeneration through loss of circulation.

30. The pallet as defined in claim 16, when used as a therapy or treatment device, further comprising:

means for permitting a predetermined volumetric flow of inflating fluid to circulate through said pallet to achieve an environmental temperature increase by the conductance of heat from the contained, pressurized inflating fluid through the first sheet underlying the load to warm the load.

31. The pallet as defined in claim 16, when used as a therapy or treatment device, further comprising:

means for permitting a predetermined volumetric flow of inflating fluid to circulate through said pallet to achieve an environmental temperature increase by the radiation of heat from the escape of the contained, pressurized inflating fluid through said escape ports in said second sheet as said inflating fluid rises alongside said pallet to warm the load.

32. The pallet as defined in claim 16 further comprising:

means for decreasing rotational instability about the longitudinal center line of the pallet, said means being the extension outward of a fulcrum plane from the center line, said fulcrum plane generally defined by said elongated chambers and substantially encompassing the footprint of the load.

33. The pallet as defined in claim 16 further comprising:

means for increasing the stability of the pallet, said means being a perimeter band placed intermediate of and interconnecting the top and bottom sheets at the peripheral edges thereof.

34. The pallet as defined in claim 16, wherein one or more of the partition members vary in size from others of the partition members, so that when the pallet is inflated, the distance between the top and bottom sheets where attached to the partition members varies so that the load supporting capability of portions of the pallet becomes variable.

35. The pallet as defined in claim 16, wherein the spacing between one or more of the laterally extending portions of the partition members and others of the laterally extending portions of the partition members varies so that the load supporting capability of portions of the pallet becomes variable.

36. The pallet as defined in claim 16, wherein one or more of the laterally extending, elongated chambers vary in size from others of said chambers such that one or more of said chambers have portions extending farther laterally outward than the others of said chambers to enhance the load supporting capability of the pallet by increasing stability of said pallet.

37. The pallet as defined in claim 16, wherein one or more of the laterally extending, elongated chambers vary in size from others of said chambers such that one or more of said chambers have portions which do not extend beyond the others of said chambers to enhance the load supporting capability of the pallet.

38. An inflatable flexible pallet for support of a load on an underlying, relatively fixed support surface, when the pallet is in a first inflated mode, and for frictionless movement of the load on the support surface when the pallet is in a second inflated mode, the pallet comprising:

top, intermediate and bottom generally rectangular, elongated sheets connected together at peripheral edges thereof, the top and intermediate sheets defining an inflatable main cavity therebetween, the main cavity having a longitudinal axis and a lateral axis, the intermediate and bottom sheets defining an inflatable plenum therebetween, the plenum having a longitudinal axis and a lateral axis;

first inlet means for communicating a first pressurized inflating fluid into the main cavity whereby the main cavity is inflated;

second inlet means for communicating a second pressurized inflating fluid into the plenum, whereby the plenum is inflated, the plenum being sealed from fluid communication with the main cavity;

a generally rectangular array of chambers formed within the main cavity, the array including a plurality of side-by-side, laterally extending, elongated chambers formed by a plurality of spaced apart partition members having laterally extending portions and longitudinally extending portions attached to the top and intermediate sheets, the longitudinally extending portions being at opposed ends of the laterally extending portions;

the array of chambers being spaced from, and framed within the peripheral edges by a continuous, rectangular cavity including a pair of opposed, laterally extending end portions and a pair of opposed, longitudinally extending side portions;

means for permitting the inflating fluid introduced into the first inlet, under pressure, to communicate freely throughout the main cavity including the end and side portions of the rectangular cavity and the chambers therein; and the bottom sheet including a portion, substantially defined by the array of chambers, having a plurality of closely spaced, small inflating fluid escape ports opening directly into the plenum whereby when the plenum is inflated, the inflating fluid therein flows through the ports to create a thin film between the bottom sheet and the support surface, whereby an increased load support surface area is provided through reduction of shrinkage of said pallet in the transverse direction to both of said lateral and longitudinal axes.

39. The pallet as defined in claim 38, further comprising:

means for preventing said plenum from hot dogging, for preventing load stability, for maintaining said support surface planar and generally parallel to the thin film created for movement of the load, for limiting shrink of the air pallet both laterally and longitudinally.

40. The pallet as defined in claim 38, wherein the laterally extending portions of the partition members have an edge attached to the top sheet and an opposite edge attached to the intermediate sheet so that when the pallet is inflated, the laterally extending portions of the partition members are extended to a substantially taut vertical position between said sheets.

41. The pallet as defined in claim 40, wherein the longitudinally extending portions of the partition members have an edge attached to the top sheet and an edge attached to the intermediate sheet so that when the pallet is inflated, the longitudinally extending portions of the partition members are extended to a substantially taut vertical position between the sheets.

42. The pallet as defined in claim 41, wherein the means for permitting fluid introduced into the inlet means to communicate freely throughout the main cavity includes a plurality of apertures formed in the longitudinally extending portions of the partition members.

43. The pallet as defined in claim 41, wherein the means for permitting fluid introduced into the inlet means to communicate freely throughout the main cavity further includes the longitudinally extending portions of the partition members being free of attachment with the laterally extending portions of the partition members.

44. The pallet as defined in claim 38, wherein the laterally extending portions of the partition members have an edge attached to the top sheet and an opposite edge attached to the intermediate sheet, the attachments being offset so that when the pallet is inflated, the laterally extending portions of the partition members include an arcuate extension as each extends to a substantially taut vertical position between the sheets.

45. The pallet as defined in claim 44, wherein the longitudinally extending portions of the partition members have an edge attached to the top sheet and an edge attached to the intermediate sheet so that when the pallet is inflated, the longitudinally extending portions of the partition members are extended to a substantially taut vertical position between the sheets.

46. The pallet as defined in claim 45, wherein the means for permitting fluid introduced into the inlet means to communicate freely throughout the main cavity includes a plurality of apertures formed in the longitudinally extending portions of the partition members.

47. The pallet as defined in claim 45, wherein the means for permitting fluid introduced into the inlet means to communicate freely throughout the main cavity further includes the longitudinally extending portions of the partition members being free of attachment with the laterally extending portions of the partition members.

48. The pallet as defined in claim 38, wherein the laterally and longitudinally extending portions of the partition members are integrally formed into a C-shaped partition member having an edge attached to the top sheet and an edge attached to the intermediate sheet so that when the pallet is inflated, the C-shaped partition member is extended to a substantially taut vertical position between the sheets.

49. The pallet as defined in claim 48, wherein the means for permitting fluid introduced into the inlet means to communicate freely throughout the main cavity includes a plurality of apertures formed in the longitudinally extending portions of the C-shaped partition member.

50. The pallet as defined in claim 48, wherein the means for permitting fluid introduced into the inlet means to communicate freely throughout the main cavity further includes each C-shaped partition member being free of attachment to an adjacent C-shaped partition member.

51. The pallet as defined in claim 38, when used as a therapy or treatment device, further comprising:

valve means for automatically maintaining a pressure within the pallet, when inflated, to prevent capillary closure and skin degeneration through loss of circulation.

52. The pallet as defined in claim 38, when used as a therapy or treatment device and configured as a flow through air pallet, further comprising:

means for automatically maintaining a pressure within the pallet, when inflated, to prevent capillary closure and skin degeneration through loss of circulation.

53. The pallet as defined in claim 38, when used as a therapy or treatment device, further comprising:

means for permitting a predetermined volumetric flow of inflating fluid to circulate through said pallet to achieve an environmental temperature increase by the conductance of heat from the contained, pressurized inflating fluid through the top sheet underlying the load to warm the load.

54. The pallet as defined in claim 38, when used as a therapy or treatment device, further comprising:

means for permitting a predetermined volumetric flow of inflating fluid to circulate through said pallet to achieve an environmental temperature increase by the radiation of heat from the escape of the contained, pressurized inflating fluid through said escape ports in said bottom sheet as said inflating fluid rises alongside said pallet to warm the load.

55. The pallet as defined in claim 38 further comprising:

means for decreasing rotational instability about the longitudinal center line of the pallet, said means being the extension outward of a fulcrum plane from the center line, said fulcrum plane generally defined by said elongated chambers and substantially encompassing the footprint of the load.

56. The pallet as defined in claim 38 further comprising:

means for increasing the stability of the pallet, said means being a perimeter band placed intermediate of and interconnecting the top and intermediate sheets at the peripheral edges thereof.

57. The pallet as defined in claim 38 further comprising:

means for increasing the stability of the pallet, said means being a perimeter band placed intermediate of and interconnecting the top, intermediate and bottom sheets at the peripheral edges thereof.

58. The pallet as defined in claim 38, wherein one or more of the partition members vary in size from others of the partition members, so that when the pallet is inflated, the distance between the top and intermediate sheets where attached to the partition members varies so that the load supporting capability of portions of the pallet becomes variable.

59. The pallet as defined in claim 38, wherein the spacing between one or more of the laterally extending portions of the partition members and others of the laterally extending portions of the partition members varies so that the load supporting capability of portions of the pallet becomes variable.

60. The pallet as defined in claim 38, wherein one or more of the laterally extending, elongated chambers vary in size from others of said chambers such that one or more of said chambers have portions extending farther laterally outward than the others of said chambers to enhance the load supporting capability of the pallet by increasing stability of said pallet.

61. The pallet as defined in claim 38, wherein one or more of the laterally extending, elongated chambers vary in size from others of said chambers such that one or more of said chambers have portions which do not extend beyond the others of said chambers to enhance the load supporting capability of the pallet.

* * * * *

UNITED STATES PATENT AND TRADEMARK OFFICE

CERTIFICATE OF CORRECTION

PATENT NO. : 5,561,873
DATED : October 8, 1996
INVENTOR(S) : Robert E. Weedling

It is certified that error appears in the above-identified patent and that said Letters Patent is hereby corrected as shown below:

Title page,
Item [75], Inventor, add -- David T. Davis, Bethlehem, PA. --

Signed and Sealed this

Ninth Day of September, 2003

JAMES E. ROGAN
*Director of the United States Patent and Trademark Office*